US009890636B2

(12) United States Patent
Hall et al.

(10) Patent No.: US 9,890,636 B2
(45) Date of Patent: Feb. 13, 2018

(54) AXIALLY STABLE RETENTION MECHANISM FOR PICKS AND CUTTING ELEMENTS

(71) Applicants: Smith International, Inc., Houston, TX (US); Schlumberger Technology Corporation, Sugar Land, TX (US)

(72) Inventors: David R. Hall, Provo, UT (US); Francis Leany, Salem, UT (US); John J. Pierce, Provo, UT (US); Youhe Zhang, Spring, TX (US); Yuri Burhan, Spring, TX (US)

(73) Assignees: SCHLUMBERGER TECHNOLOGY CORPORATION, Sugar Land, TX (US); SMITH INTERNATIONAL, INC., Houston, TX (US)

( * ) Notice: Subject to any disclaimer, the term of this patent is extended or adjusted under 35 U.S.C. 154(b) by 348 days.

(21) Appl. No.: 14/282,813

(22) Filed: May 20, 2014

(65) Prior Publication Data

US 2014/0339882 A1 Nov. 20, 2014

Related U.S. Application Data

(60) Provisional application No. 61/825,471, filed on May 20, 2013.

(51) Int. Cl.
*E21C 35/197* (2006.01)
*B28D 1/18* (2006.01)

(52) U.S. Cl.
CPC ..... *E21C 35/197* (2013.01); *B28D 1/188* (2013.01)

(58) Field of Classification Search
CPC ..... E21C 35/197; E21C 35/19; E21B 10/573; E21B 2010/564; E21B 10/633
See application file for complete search history.

(56) References Cited

U.S. PATENT DOCUMENTS 3,752,515 A 8/1973 Oaks et al.
3,767,266 A * 10/1973 Krekeler ..... E21C 35/197 299/107
3,865,437 A * 2/1975 Crosby ..... E21C 35/197 175/354
4,084,856 A * 4/1978 Emmerich ..... E21C 35/197 175/354
4,327,947 A * 5/1982 Bower, Jr. ..... E21C 35/197 279/19.7
4,346,934 A * 8/1982 College ..... E21C 35/197 175/354
4,582,364 A * 4/1986 deMey, III ..... E21C 35/197 299/107
4,611,417 A * 9/1986 Carlson ..... E02F 9/2816 299/108
5,415,462 A * 5/1995 Massa ..... E21C 35/197 299/106
5,628,549 A * 5/1997 Ritchey ..... E21C 35/197 299/104
5,730,502 A * 3/1998 Montgomery, Jr. .. E21C 35/197 299/104

(Continued)

*Primary Examiner* — David J Bagnell
*Assistant Examiner* — Michael A Goodwin

(57) ABSTRACT

A cutting element assembly includes a cutting element partially disposed within a support and a retention mechanism disposed between the cutting element and the support, both the axial and radial dimensions of the retention mechanism being deformable.

21 Claims, 43 Drawing Sheets

(56) References Cited

U.S. PATENT DOCUMENTS

| | | | | |
|---|---|---|---|---|
| 6,623,084 | B1 * | 9/2003 | Wasyleczko | E21C 35/197 299/104 |
| 2008/0030065 | A1 * | 2/2008 | Frear | E21C 35/197 299/104 |
| 2008/0308981 | A1 * | 12/2008 | Exel | E21C 35/197 267/292 |
| 2009/0058173 | A1 * | 3/2009 | Monyak | E21C 35/197 299/106 |
| 2014/0054094 | A1 * | 2/2014 | Burhan | E21B 10/50 175/354 |
| 2015/0300166 | A1 * | 10/2015 | Ries | E21C 35/1933 299/105 |

* cited by examiner

AXIALLY STABLE RETENTION MECHANISM FOR PICKS AND CUTTING ELEMENTS

CROSS-REFERENCE TO RELATED APPLICATIONS

This application claims the benefit of U.S. Provisional Application 61/825,471 filed on May 20, 2013, which is herein incorporated by reference in its entirety.

BACKGROUND

Cutting elements and cutting tools have been secured within retention mechanisms using various methods. For example, cutting elements may be secured within retention mechanisms on drill bits or other tools using various types of retention mechanisms. In excavation tools, cutting elements may be securely attached to a block disposed on a driving mechanism of the excavation tool. However, over time, abrasive materials may accumulate between the cutting tool and the block, causing wear to occur if the pick tool is allowed to rotate around or move axially in or out of a block. Furthermore, if retention is not achieved, the cutting tool may be thrown or knocked out of the block.

SUMMARY

In one aspect, embodiments disclosed herein relate to a cutting element assembly that includes a cutting element partially disposed within a support and a retention mechanism disposed between the cutting element and the support, both the axial and radial dimensions of the retention mechanism being deformable.

In another aspect, embodiments disclosed herein relate to a cutting element assembly that includes a cutting element partially disposed within a support and a retention mechanism disposed between the cutting element and the support, the retention mechanism comprising an arcuate cross-sectional shape, the radial dimension of the retention mechanism being deformable.

In yet another aspect, embodiments disclosed herein relate to a cutting element that includes a cutting end, the cutting end having a cutting face, a body, and a retention end opposite the cutting end, the retention end being formed of a different material than the body. The retention end may include at least one slit extending an axial distance along a partial height of the retention end and extending a transverse distance between the outer circumference of the retention end.

Other aspects and advantages of the disclosure will be apparent from the following description and the appended claims.

DETAILED DESCRIPTION

Figure 1:
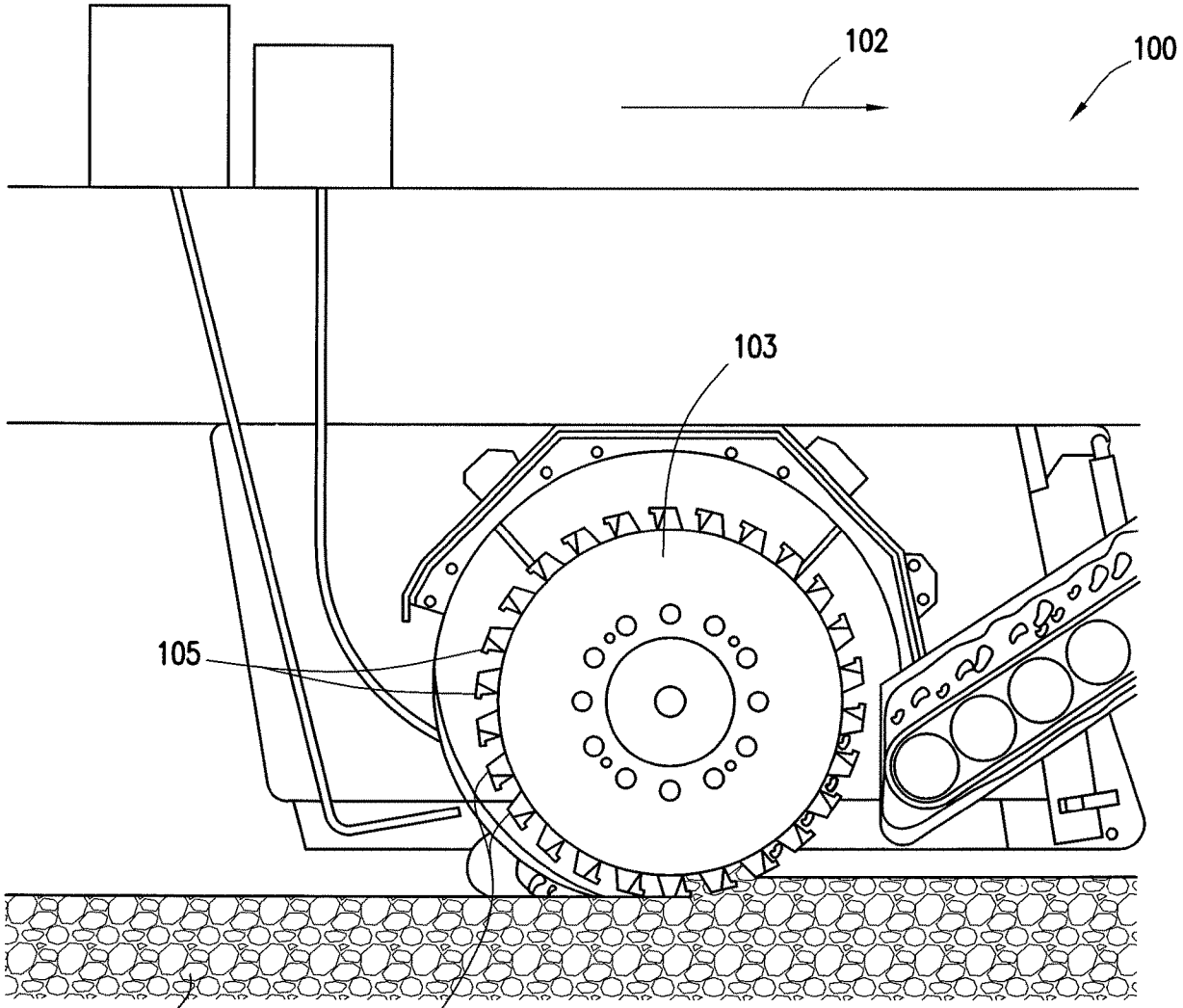
FIG. 1 shows a cutting tool according to embodiments of the present disclosure.

Embodiments disclosed herein relate generally to retention mechanisms designed to axially retain cutting elements within a cutting tool. In some embodiments, retention mechanisms may be used to retain rotatable cutting elements, where the rotatable cutting elements are axially retained to a cutting tool, but are free to rotate about their axis. In other embodiments, retention mechanisms may be used to retain fixed cutting elements, where the fixed cutting elements are axially retained to a cutting tool and do not rotate about their axis. Such cutting tools may include downhole cutting tools (such as drill bits) or surface tools including picks.

Retention mechanisms of the present disclosure may be used in a cutting element assembly, where the cutting element assembly includes a cutting element partially disposed within and axially retained to a support using the retention mechanism, and where the retention mechanism is both axially and radially flexible between the cutting element and the support. In other words, the retention mechanism may be compliant or deformable in both the axial and radial directions. In some embodiments, the cutting element may be designed to be rotatable, for example, by designing the shape of the cutting element, the position (e.g., angle and orientation) of the cutting element with respect to the direction of cut, and the materials used to form the cutting element (e.g., low friction material proximate the retention mechanism). In some embodiments, the cutting element may be designed to be fixed within the support, such that the fixed cutting element is inhibited from moving axially or rotatably within the support. As described below, a support may include a block, a sleeve, or the body of a cutting tool, depending on, for example, the type of cutting tool.

According to embodiments of the present disclosure, a retention mechanism may include a height along its axial direction and an outer diameter along its radial direction, where both the height and the diameter are flexible or deformable. In other words, both the height and the diameter of a retention mechanism may be compressible or expandable. Further, changes in dimensions of a retention mechanism may be related, where as one of the height or diameter is compressed, the other of the height or diameter expands, and vice versa. According to embodiments of the present disclosure, a retention mechanism may include a compliant clamp or an adjustable ring, and may be formed of a single piece or multiple pieces.

Retention of Fixed Cutting Elements

In some embodiments, the disclosure relates to an improved compliant ring which may be used to retain a cutting element's shank in a bore of a block. The compliant ring may include an arcuate or bow-like cross section which enables a spring-like action when compressed axially. Using a compliant retention ring whose axial ends are compressed may improve upon the existing designs by reducing the chances of the cutting element being thrown or knocked out of the block in which it may be disposed. This may be accomplished because compressing such a compliant clamp will increase the force that the compliant clamp exerts on the inside surface of a bore in a block; which, in turn, may increase the frictional force which retains the cutting tool in the block, prevents axial movement and may or may not prevent rotation of the cutting element.

FIG. 1 discloses an embodiment of a road milling machine 100. The road milling machine 100, also known as a cold planar, may be used to degrade a natural or man-made formation 101 such as pavement, concrete, or asphalt prior to placement of a new layer. The arrow 102 shows the machine's direction of travel. The road milling machine 100 may have a degradation platform; in the present embodiment, the degradation platform is a degradation drum 103. The degradation drum 103 may include a plurality of blocks 104 secured to its outer surface. A plurality of cutting elements referred to as picks 105 may be secured to the degradation drum 103 with the plurality of blocks 104.

During normal operation, the degradation drum 103 may be configured to rotate, causing the picks 105 to engage and degrade the formation 101. In other embodiments of the present disclosure, the degradation platform may be a chain, blade, drill bit, or other moving part of a mining, trenching or road milling machine that may cause picks to engage and degrade formations of various types.

Figure 2:
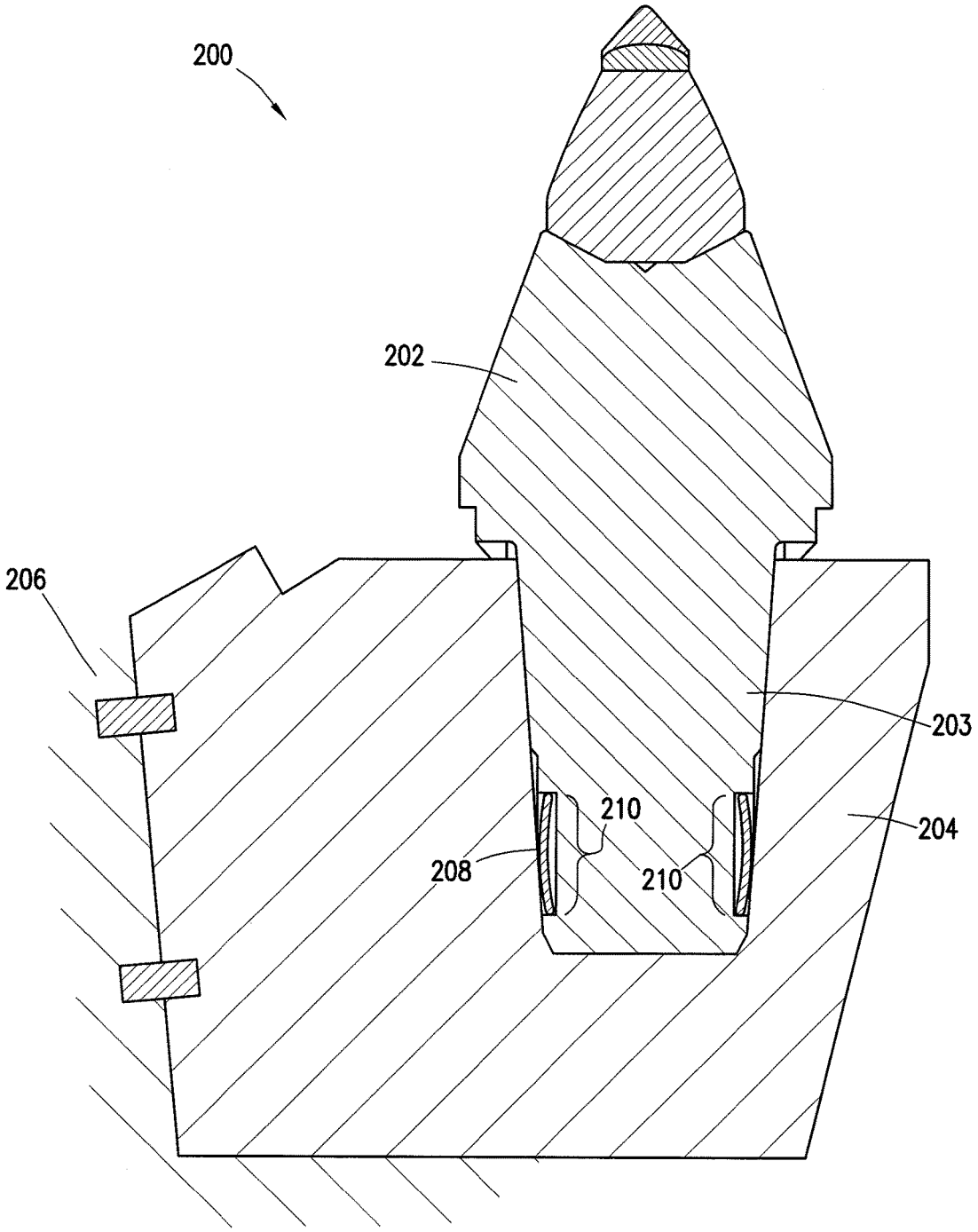
FIG. 2 shows a cross-sectional view of a retention mechanism according to embodiments of the present disclosure.

FIG. 2 discloses a cross-sectional view of an embodiment of a pick retention mechanism 200. Disclosed is a cutting element 202 disposed in a receiving element 204, or support, disposed on a driving mechanism 206 of an excavation tool (not shown). The cutting element 202 may be retained in the receiving element 204 by a compliant clamp 208 disposed in a circumferential groove 210 which is disposed on the shank 203 of the cutting element 202. The compliant clamp 208 may include an arcuate or bow-like cross-section and may include a metallic material such as steel. The circumferential compliant clamp may aid in preventing rotational or axial movement of the cutting element while remaining simple to install and remove. Preventing axial movement of the cutting element 202 may prevent the cutting element from leaving the support or receiving element during an excavation or other cutting process. During an excavation process, abrasive particles may accumulate between the shank 203 of the cutting element 202 and the support 204. The shank 203 of the cutting element 202 may wear down and be more likely to leave the support 204 if it were to rotate because the abrasive particles may grind down the surface of the shank 203. Preventing rotation of the cutting element 202 may prevent the shank 203 of the cutting element 202 from wearing down and thus prolong the life of the cutting element 202. This may be beneficial because of the costly nature of halting an excavation process to replace parts. However, other embodiments, discussed below, may be configured such that the cutting element is allowed to rotate within the support (yet with limited axial movement). Such rotational movement may be desired, for example, when the cutting element is subjected to substantially constant or continuous contact with the material to be cut, thus generating high frictional heat that would cause premature wear or failure as compared to if the cutting element were allowed to cool by rotation. Thus, depending on the type of application, and the likely failure mode, any of the embodiments described herein may be adjusted to allow for rotation of the cutting element within a support in which the cutting element is axially retained.

Figure 3:
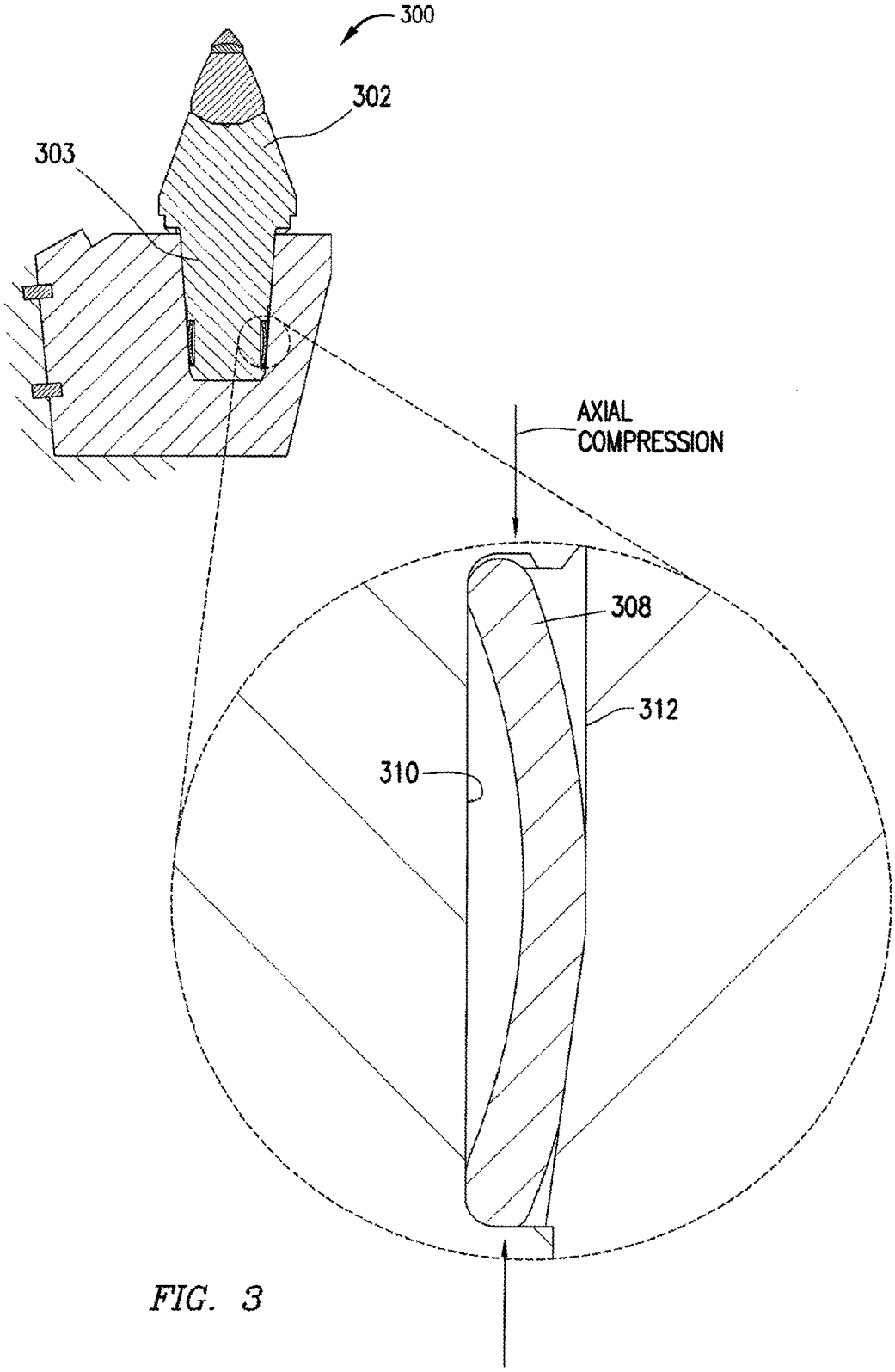
FIG. 3 shows a cross-sectional view of a retention mechanism according to embodiments of the present disclosure.

FIG. 3 discloses an enlarged cross-sectional view of an embodiment of a pick retention mechanism 300. Disclosed is a compliant clamp 308 disposed in a circumferential groove 310 disposed on a shank 303 of a cutting element 302. The compliant clamp 308 may be axially longer than the circumferential groove 310. The compliant clamp 308 may have an arcuate cross-section. It is believed that the arcuate cross-section may allow for the compliant clamp to withstand substantial axial compression. The compliant clamp may be axially compressed in the circumferential groove. This compression may enhance the force applied to a bore-hole wall 312 by the compliant clamp 308. This may enhance retention by increasing the frictional force between the bore-hole wall 312, the compliant clamp 308, and the circumferential groove 310, thereby allowing the compliant clamp to retain the shank 303 in the bore hole 312 and prevent rotation of the cutting element 312. For embodiments in which the cutting element rotates within the support, the rotation of the cutting element may be achieved by overcoming the frictional force that would otherwise keep the cutting element from rotating. Overcoming the frictional force may be achieved, for example, by modification of one or more surfaces with which the compliant clamp interfaces and/or orienting the cutting element (with respect to the material being cut) in a manner such that a side cutting force is generated that may exceed the frictional force.

Figure 4A:
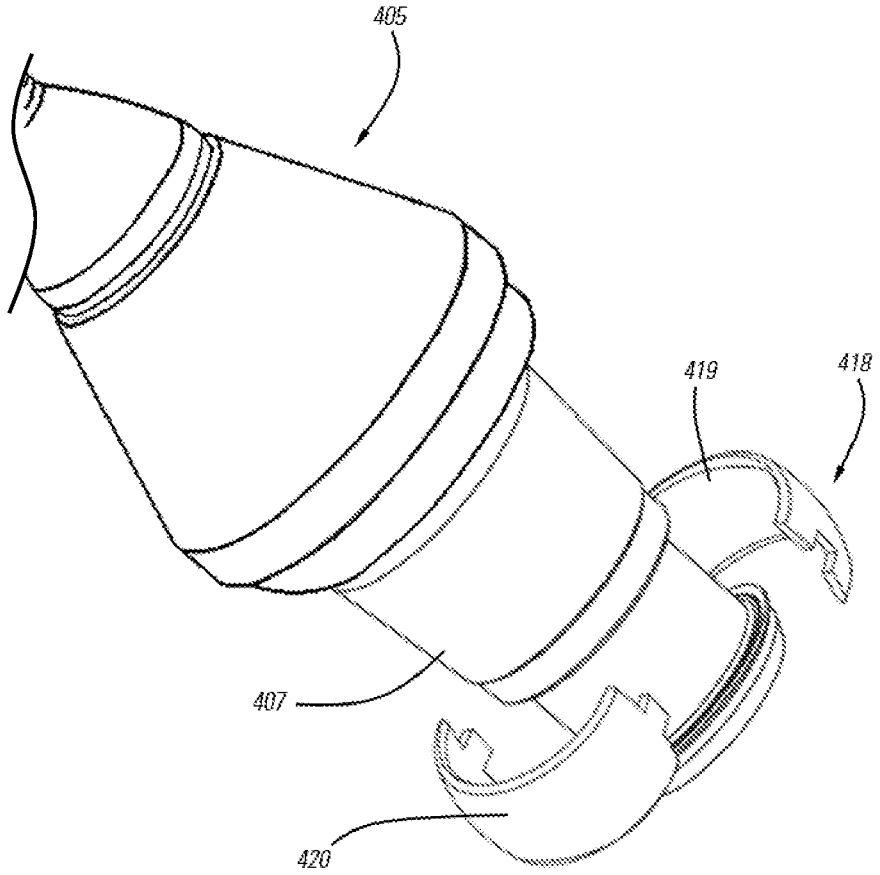
FIG. 4*a* shows an exploded view of a cutting element and retention mechanism according to embodiments of the present disclosure.

FIG. 4*a* discloses an exploded view of an embodiment of a pick 405 cutting element and a split compliant clamp 418 retention mechanism. The split compliant clamp 418 may include at least two partial clamps, a first split compliant clamp 419 and a second split compliant clamp 420, wherein the first split compliant clamp 419 and second split compliant clamp 420 may combine to produce a full ring. However, in other embodiments, a compliant clamp retention mechanism may be a single piece. Further, in some embodiments, a compliant clamp retention mechanism may not extend to a full ring, but may instead extend between greater than 180 degrees around the cutting element and less than 360 degrees around the cutting element.

Figure 4B:
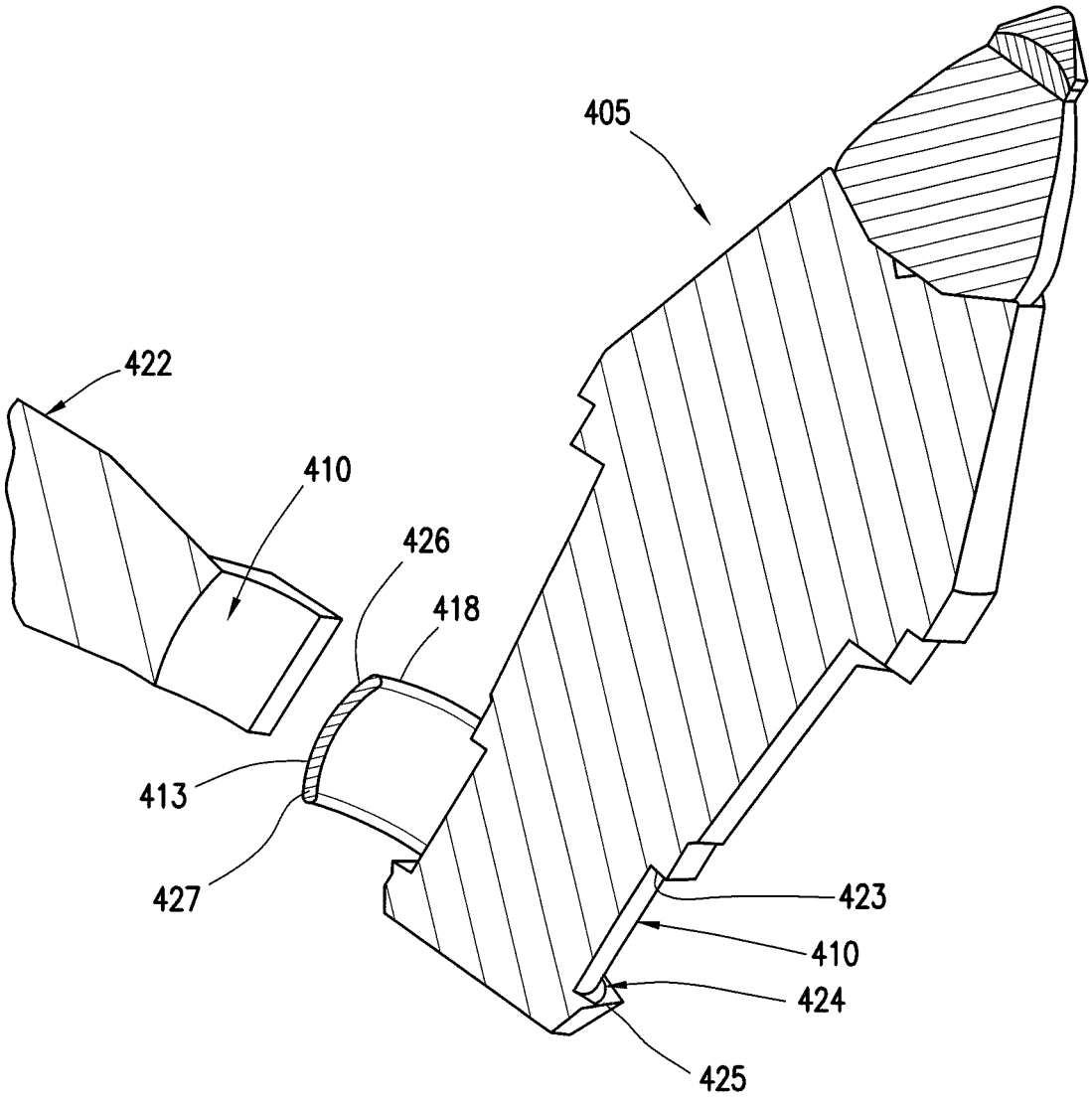
FIG. 4*b* shows a cross-sectional view of a cutting element and retention mechanism according to embodiments of the present disclosure.

FIG. 4*b* discloses a section view of another embodiment of the pick 405, the split compliant clamp 418, and a tool 422. The tool 422 may include an annular recess 410, wherein the annular recess 410 may match the external surface geometry of the split compliant clamp 418. The pick 405 may have an annular recess 410 wherein the upper portion may include a top race 423 and the lower portion may include a bottom race 424 and a lip 425. The top race 423 may substantially match the geometry of a top flange 426 of the split compliant clamp 418 and the bottom race 424 may substantially match the geometry of a bottom flange 427 of the split compliant clamp 418.

Figure 4C:
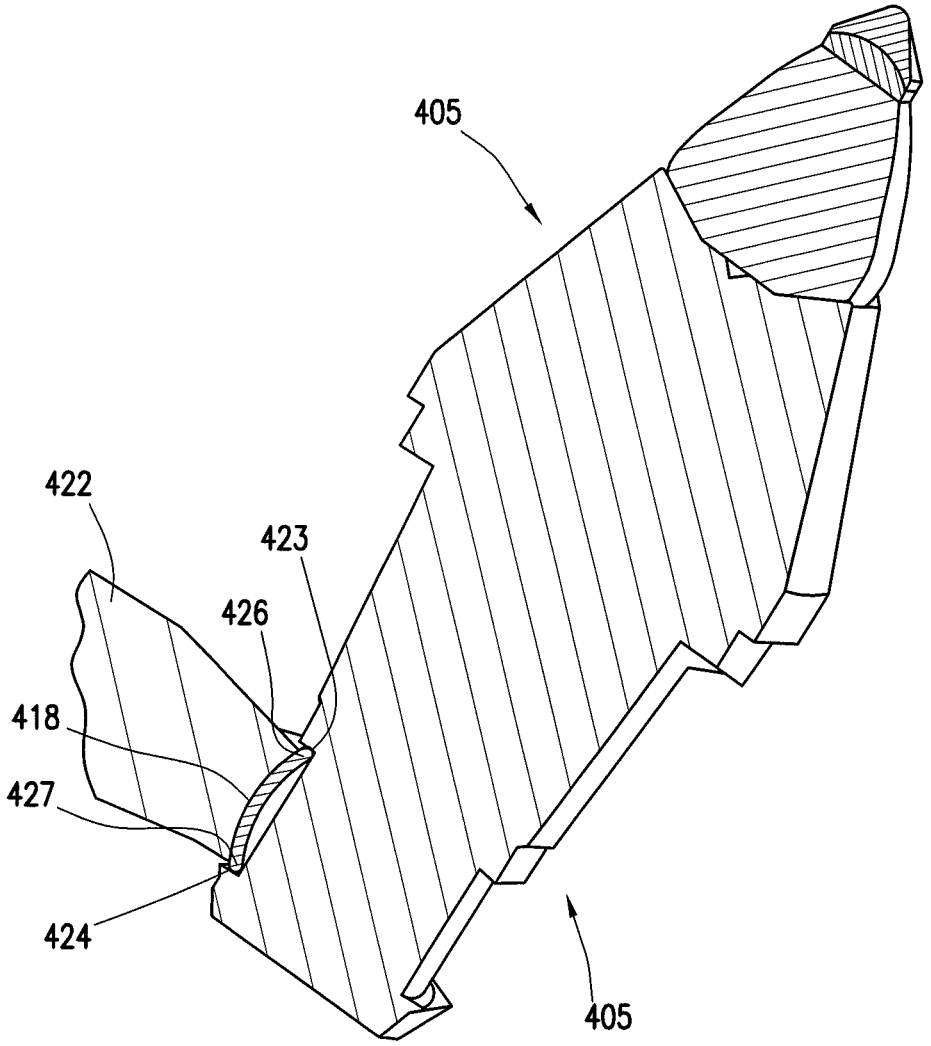
FIG. 4*c* shows a cross-sectional view of a cutting element and retention mechanism according to embodiments of the present disclosure.

FIG. 4*c* discloses a section view of another embodiment of the pick 405, the split compliant clamp 418, and the tool 422. The tool 422 may press the top flange 426 of the split compliant clamp 418 into a top race 423 of the pick 405 and the bottom flange 427 of the split compliant clamp 418 into a bottom race 424 of the pick.

Figure 4D:
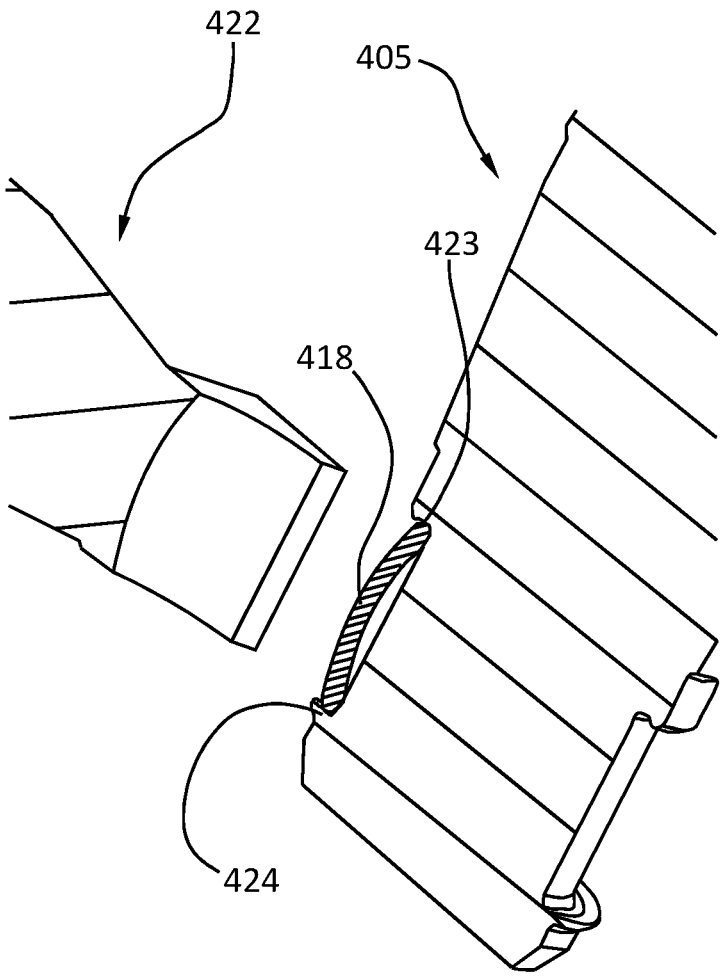
FIG. 4*d* shows a cross-sectional view of a cutting element and retention mechanism according to embodiments of the present disclosure.

FIG. 4*d* discloses a section view of another embodiment of the pick 405, the split compliant clamp 418, and the tool 422. The tool 422 is removed from the compliant clamp 418 leaving the split compliant clamp 418 secured within the top race 423 and the bottom race 424.

Figure 4E:
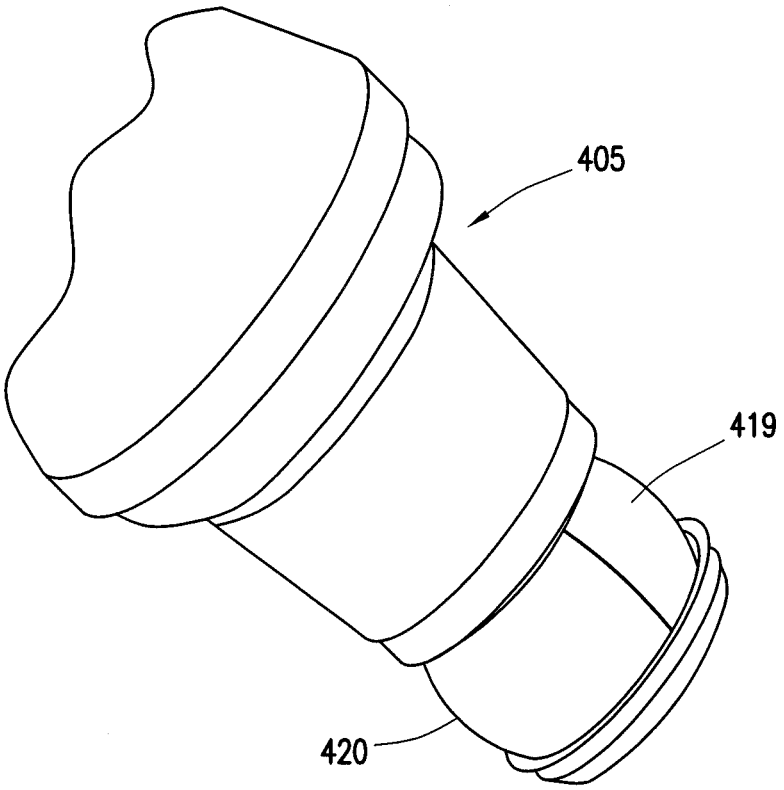
FIG. 4*e* shows a perspective view of a cutting element and retention mechanism according to embodiments of the present disclosure.

FIG. 4*e* discloses a perspective view of another embodiment of a pick 405 wherein a first split compliant clamp 419 and a second split compliant clamp 420 encompass a portion of the pick 405.

Figure 5A:
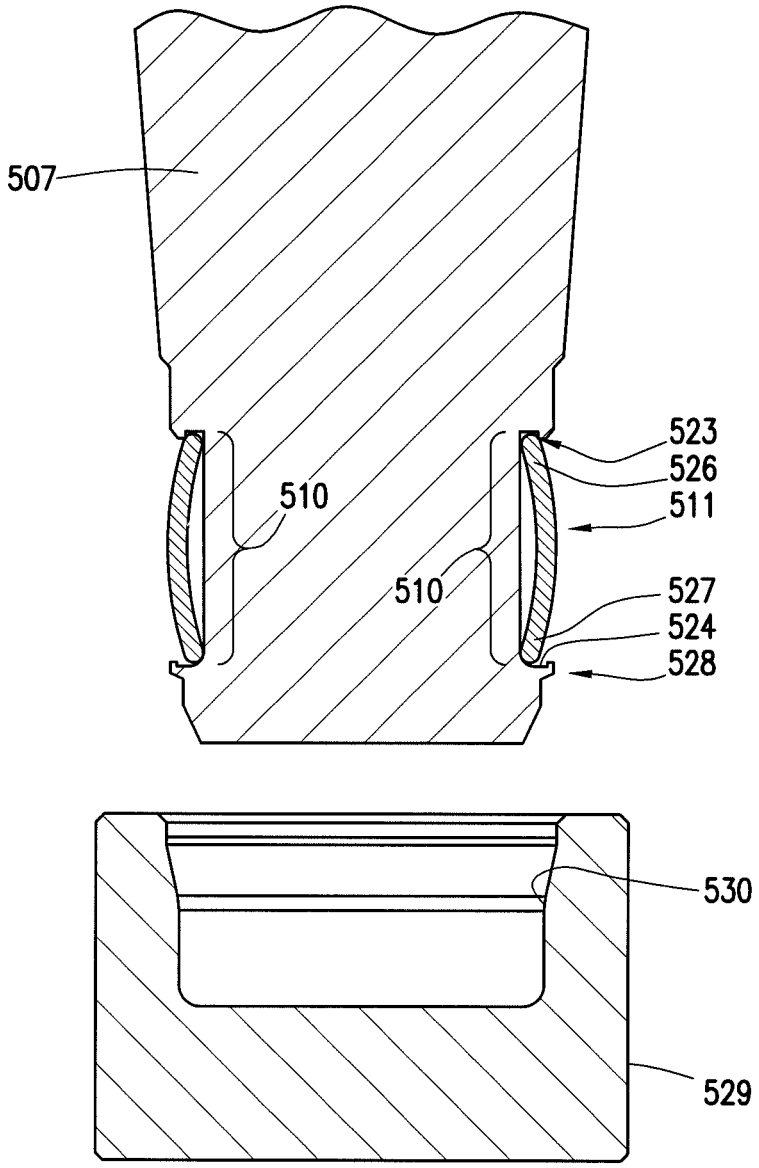
FIG. 5*a* shows a cross-sectional view of a cutting element and retention mechanism according to embodiments of the present disclosure.

FIG. 5*a* discloses a section view of an embodiment of a shank 507 further having a compliant clamp 511 secured within an annular recess 510 of the shank 507 wherein a top flange 526 of the compliant clamp is secured in a top race 523 of the recess 510 and a bottom flange 527 is secured in a bottom race 524. The shank 507 may have an annular rim 528 on the lower end of the shank, which may form a pliable connection to the shank 507. A crimping tool 529 may be used to bend the rim 528 which may further aid in securing the compliant clamp 511 in the recess 510. The crimping tool 529 may include a crimping tool cavity 530 which may have a geometry that will aid in the bending of the rim 528 to secure the compliant clamp 511 in the recess 510. The crimpling tool 529 may be manufactured out of any material of any stiffness that will be sufficient to bend the rim 528.

Figure 5B:
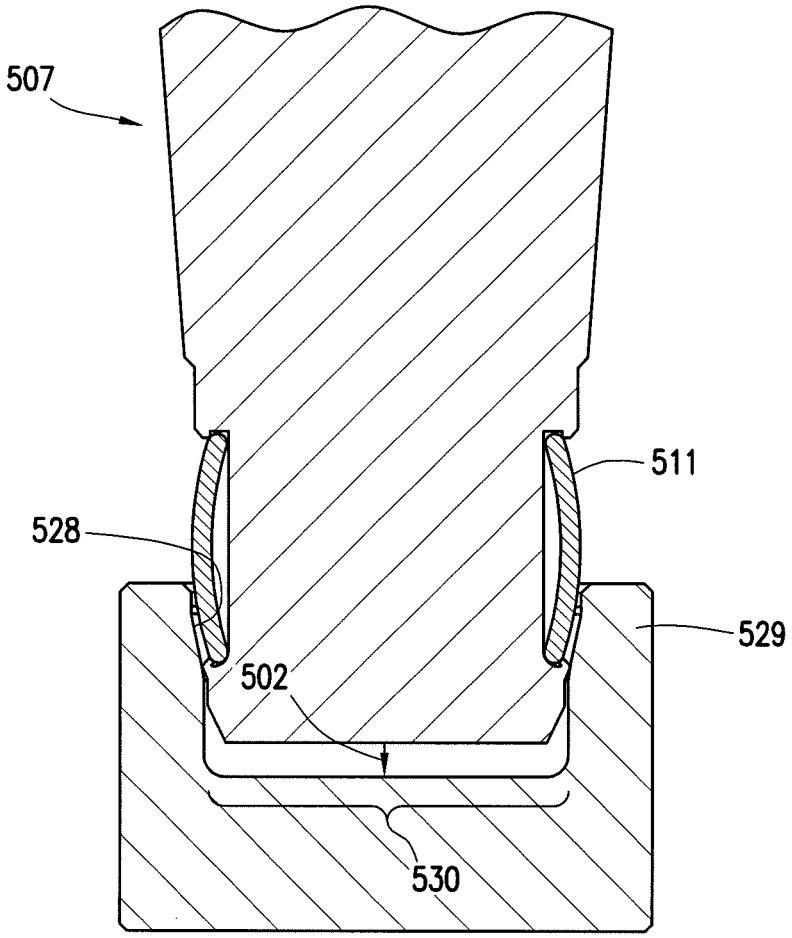
FIG. 5*b* shows a cutting element and retention mechanism according to embodiments of the present disclosure.

FIG. 5*b* discloses a view of another embodiment of the shank 507 having the compliant clamp 511 and the rim 528. In this embodiment, the shank 507 is being pressed into a crimping tool cavity 530 of a crimping tool 529. The rim 528 of the shank 507 is being bent inwards to the compliant clamp 511. The arrow 502 shows the direction of motion of the shank 507.

Figure 5C:
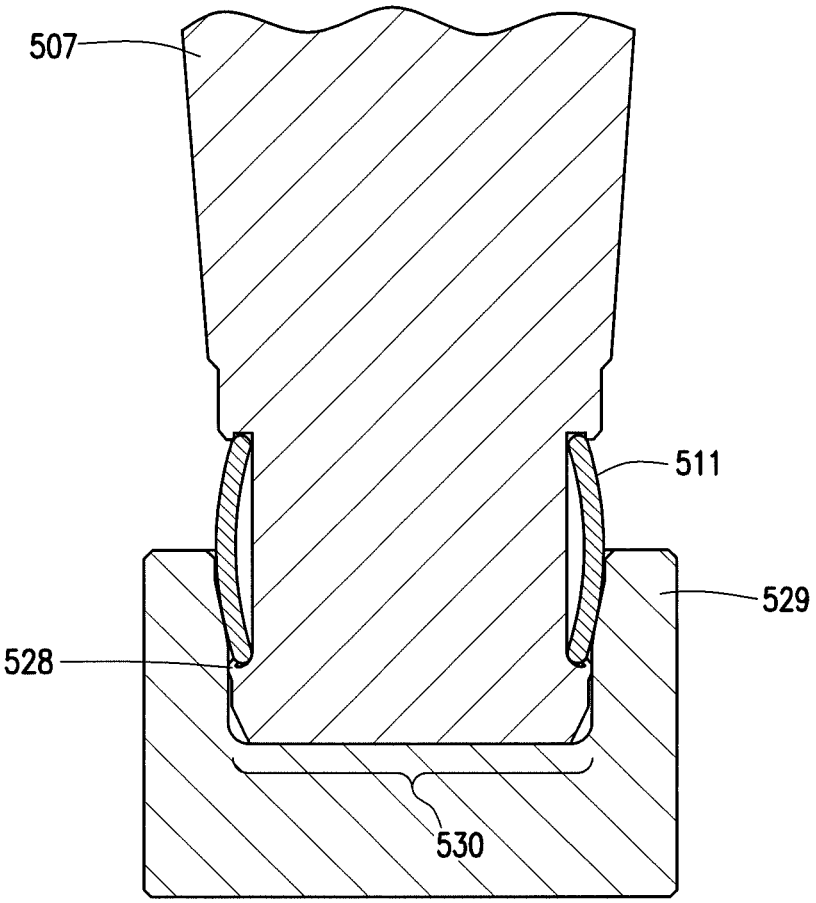
FIG. 5*c* shows a cutting element and retention mechanism according to embodiments of the present disclosure.

FIG. 5*c* discloses a view of another embodiment of the shank 507 having the compliant clamp 511 and the rim 528. The shank 507 has been pressed into the crimping tool cavity 530 of the crimping tool 529. The rim 528 is bent inwards to the compliant clamp 511 into a desired orientation.

Figure 5D:
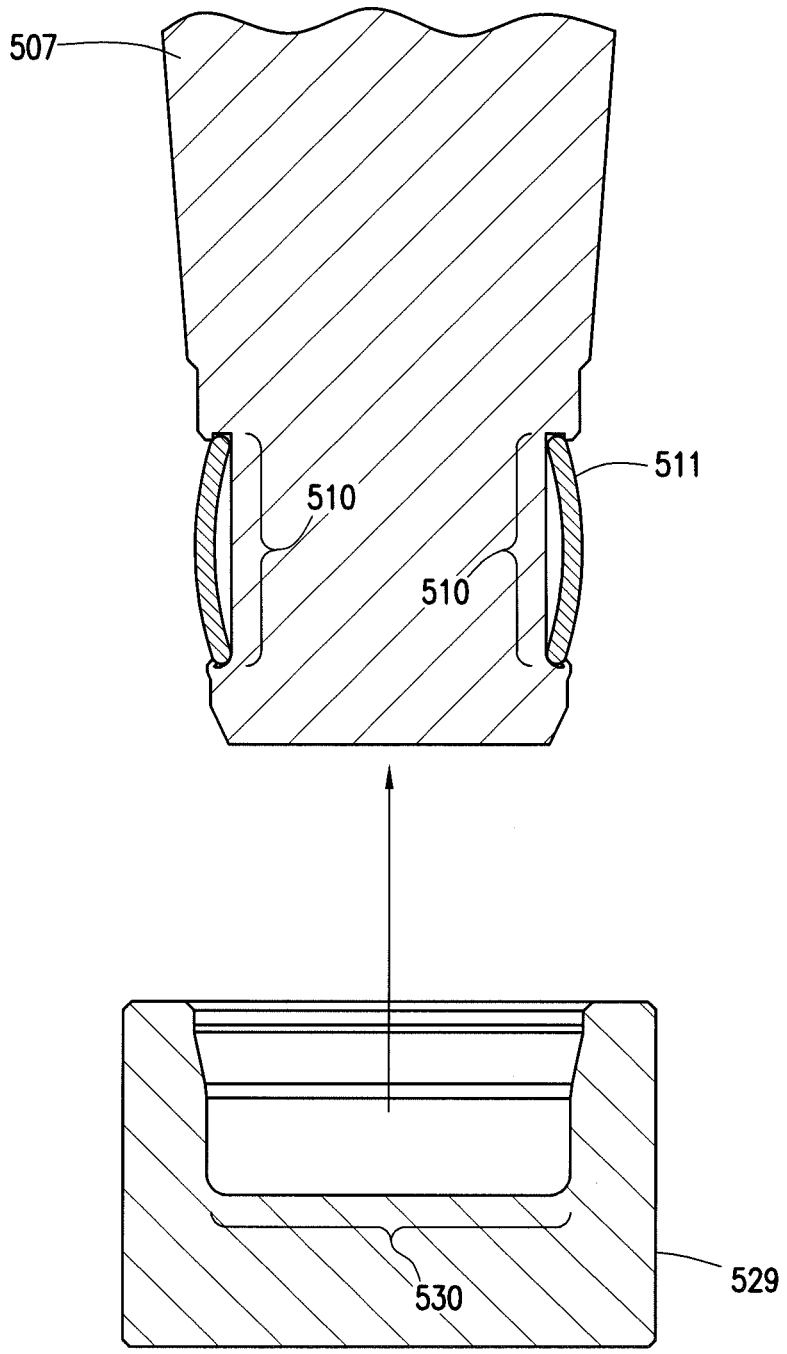
FIG. 5*d* shows a cutting element and retention mechanism according to embodiments of the present disclosure.

FIG. 5*d* discloses another embodiment of the shank 507 having the compliant clamp 511 and the rim 528. The shank 507 has been removed from the crimping tool cavity 530 of the crimping tool. The rim 528 secures the compliant clamp 511 into the annular recess 510 of the shank. The rim 528 securing the compliant clamp 511 on the shank may prevent the shank 507 from rotational movement.

Figure 6:
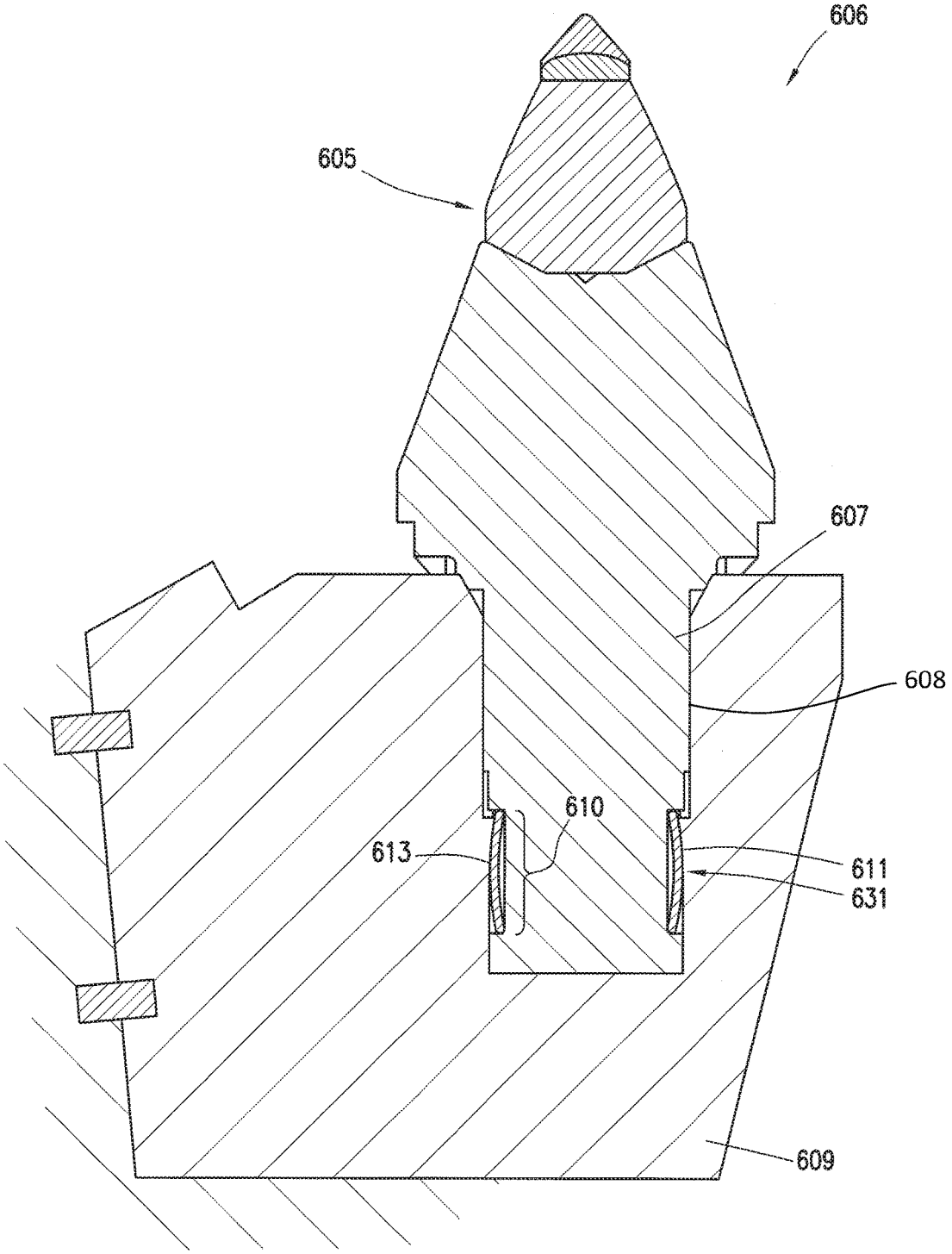
FIG. 6 shows a cross-sectional view of a cutting element assembly according to embodiments of the present disclosure.

FIG. 6 discloses an embodiment of a degradation assembly 606 after a pick shank 607 has been received into a bore 608 of a receiving element 609. In this embodiment, the shank 607 has a compliant clamp 611 on an annular recess 610. The bore 608 of the receiving element 609 may include an inside surface that is complementary to the outside surface of the pick shank 607. In the current embodiment, the inside surface of the bore 608 has an annular arcuate recess 631 in which an arcuate surface 613 of the compliant clamp 611 may become fixed. When the compliant clamp 611 is disposed in the annular arcuate recess 631 it may prevent rotational and axial movement of the pick 605.

Figure 7:
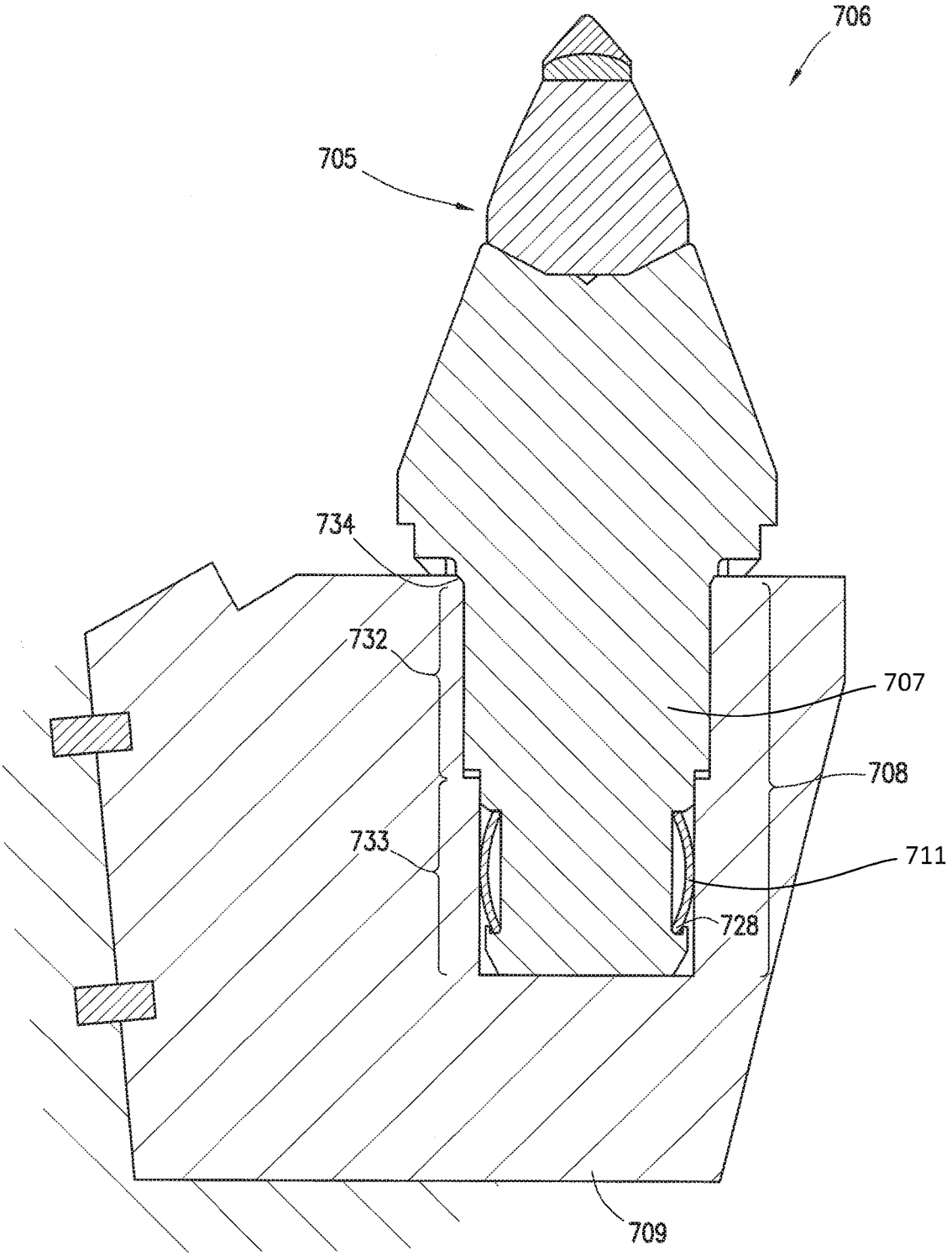
FIG. 7 shows a cross-sectional view of a cutting element assembly according to embodiments of the present disclosure.

FIG. 7 discloses an embodiment of a degradation assembly 706 after a pick shank 707 has been received into a bore 708 of a receiving element 709. In this embodiment, the shank 707 has a compliant clamp 711 secured around its circumference. The bore 708 of the receiving element 709 may include an inside surface that is complementary to the outside surface of the pick shank 707. In the current embodiment, the bore 708 may include a plurality of bores. In this embodiment, the bore 708 has a first bore 732 and a second bore 733. The first bore 732 may have a larger diameter than the second bore 733. The variable diameters of the first bore 732 and the second bore 733 allow an ease of placement of the pick 705 with the compliant clamp 711 into the bore 708. After the compliant clamp 711 has been disposed into the first bore 732, the pick 705 with the compliant clamp 711 may be pressed into the second bore 733. The second bore 733 may compress the compliant clamp 711 so that there may be no axial or rotational movement. The pick block may have an annular chamfer 734 at the top portion of the receiving element 709. The annular chamfer 734 may be used as a crimping tool to crimp the rim 728 of the shank 707. This process may shorten manufacturing processes to eliminate or reduce the need of a separate crimping tool to crimp the rim 728 as shown in FIG. 5*a* and FIG. 5*d*.

Figure 8A:
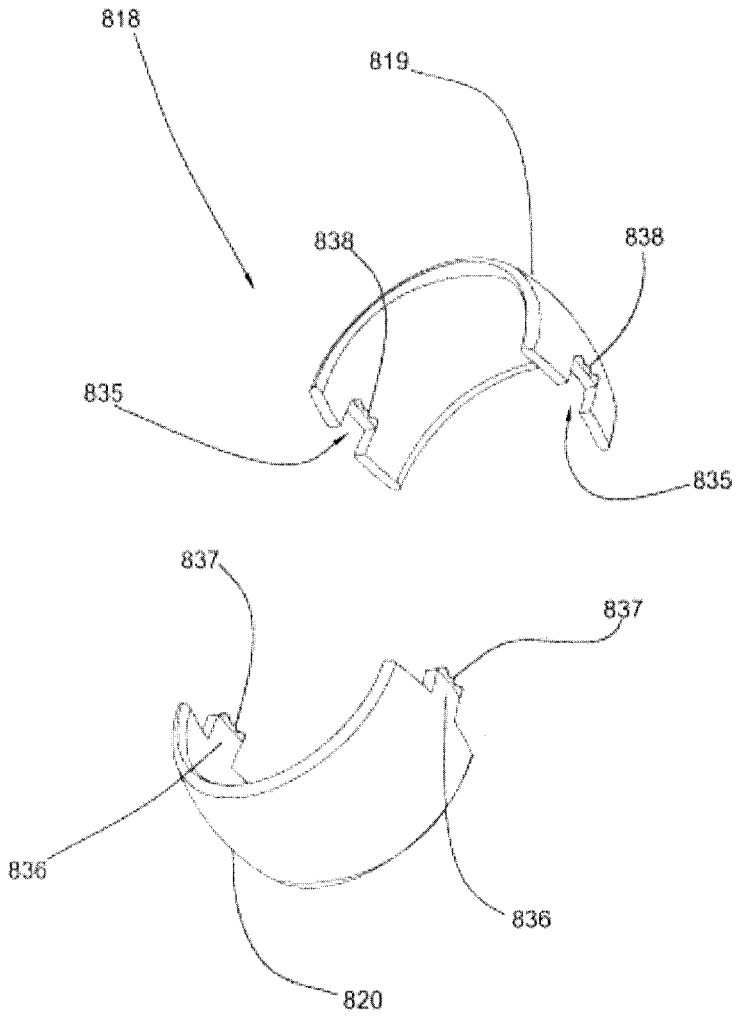
FIG. 8*a* is a perspective view of a retention mechanism according to embodiments of the present disclosure.

FIG. 8*a* discloses a perspective view of an embodiment of a split compliant clamp 818. In this embodiment, the split compliant clamp 818 may include a first split compliant clamp 819 and a second split compliant clamp 820. Each of the first split compliant clamp 819 and the second split compliant clamp 820 may include a female end 835 and a male end 836. The male end 836 may include a protruding portion 837 and the female end 835 may include depressed portion 838 wherein the protruding portion 837 and the depressed portion 838 are complimentary of their geometries. The geometry of the protruding portion 837 and the depressed portion 838 may be notched, squared, fully interlocking, and the like.

Figure 8B:
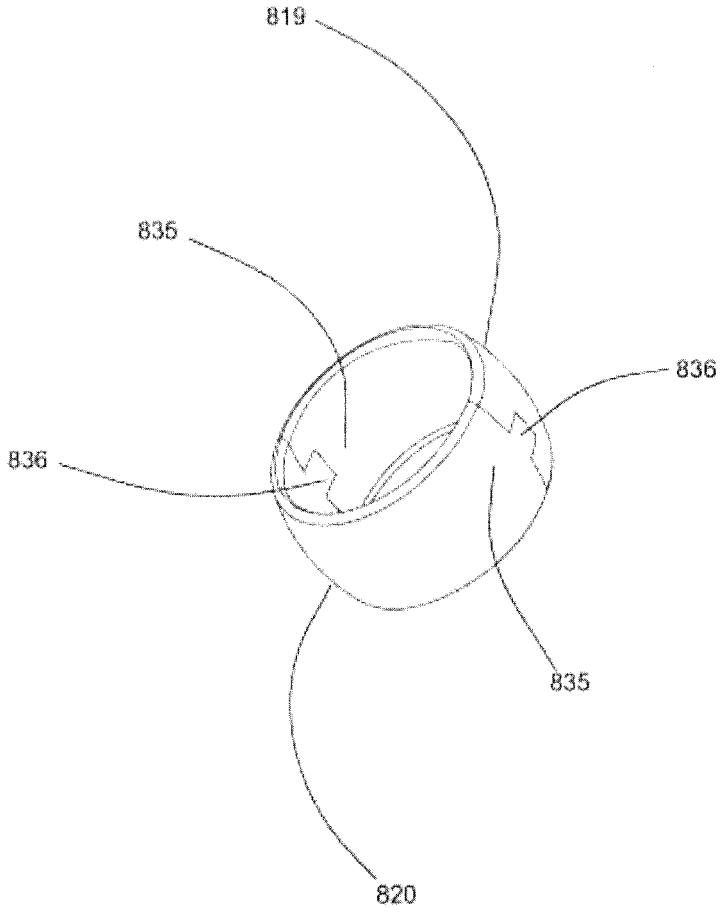
FIG. 8*b* is a perspective view of a retention mechanism according to embodiments of the present disclosure.

FIG. 8*b* discloses a perspective view of another embodiment of the split compliant clamp 818. In this embodiment, the male end 836 of the first split compliant clamp 819 is mated with the female end 835 of the second split compliant clamp 820 and the male end 836 of the second split complaint clamp 820 is mated with the female end 835 of the first split compliant clamp 819. As shown in FIG. 5*e*, the split compliant clamp 818 may be used on the shank of the pick.

Figure 9A:
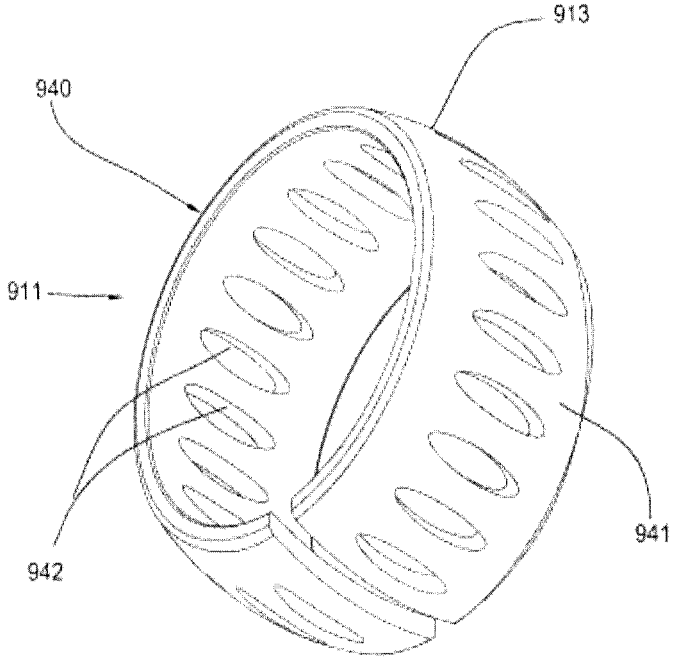
FIG. 9*a* is a perspective view of a retention mechanism according to embodiments of the present disclosure.
Figure 15A:
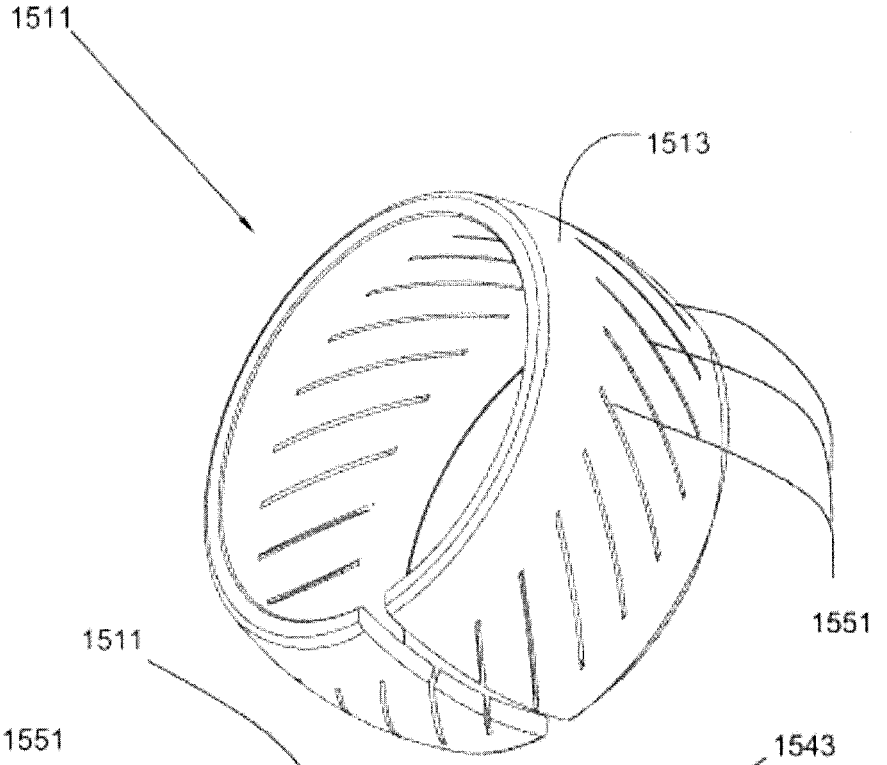
FIG. 15*a* shows a perspective view of a retention mechanism according to embodiments of the present disclosure.
Figure 15B:
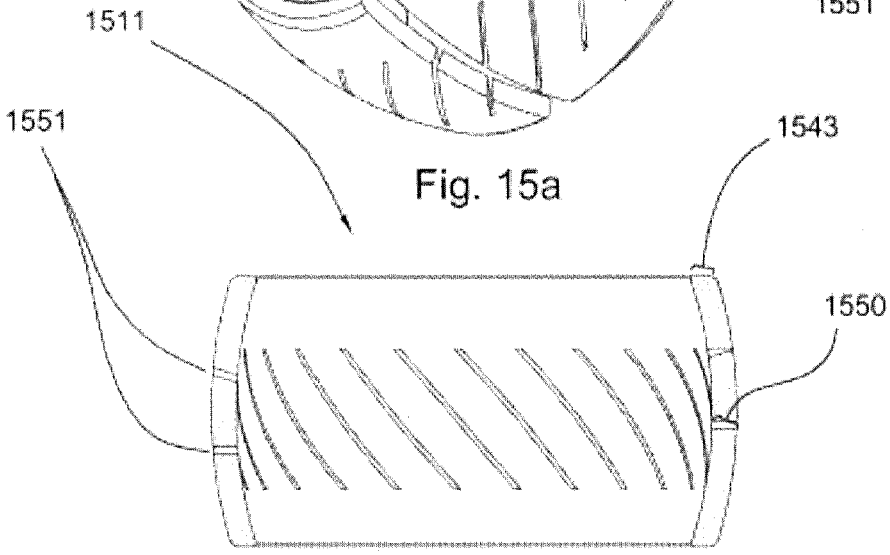
FIG. 15*b* shows a cross-sectional view of a retention mechanism according to embodiments of the present disclosure.

FIG. 9*a* discloses a perspective view of an embodiment of a retention mechanism. The retention mechanism is a compliant clamp 911 having an arcuate surface 913, a first flange 940, and a second flange 941. In this embodiment, a plurality of flutes 942 may be machined into the arcuate surface. The flutes 942 shown in FIG. 9*a* are through-cuts extending through the entire thickness of the compliant clamp 911 wall that have an elliptical shape. However, other shapes of through-cuts extending through the entire thickness of a retention mechanism wall may be used. For example, as shown in FIGS. 15*a* and 15*b*, through-cuts formed in a retention mechanism may have a slit shape.

Figure 9B:
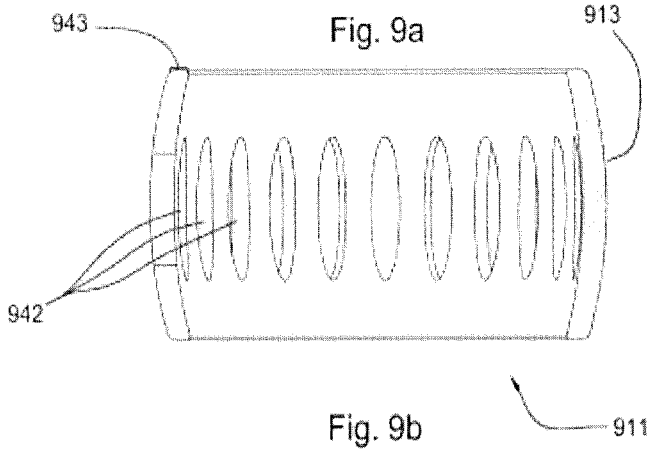
FIG. 9*b* is a cross-sectional view of a retention mechanism according to embodiments of the present disclosure.

FIG. 9*b* discloses a cross section view of another embodiment of the compliant clamp 911 wherein the flute 942 may be machined to a depth of the entirety of a thickness 943 of the compliant clamp 911. The plurality of flutes 942 may encompass the entirety of the arcuate surface 913. The plurality of flutes 942 may aid in preventing rotational and axial movement of a pick.

Retention mechanisms of the present disclosure may include one or more surface alterations formed in the outer surface and/or inner surface of the retention mechanism. Surface alterations may include, for example, grooves, protrusions, and depressions, and may have a variety of shapes and sizes, for example, extending a partial depth into the thickness of the retention mechanism wall and extending around the entire circumference of the retention mechanism. FIGS. 10-14*b* and 16-17*b* show examples of retention mechanisms having surface alterations formed on a surface of the retention mechanism.

Figure 10:
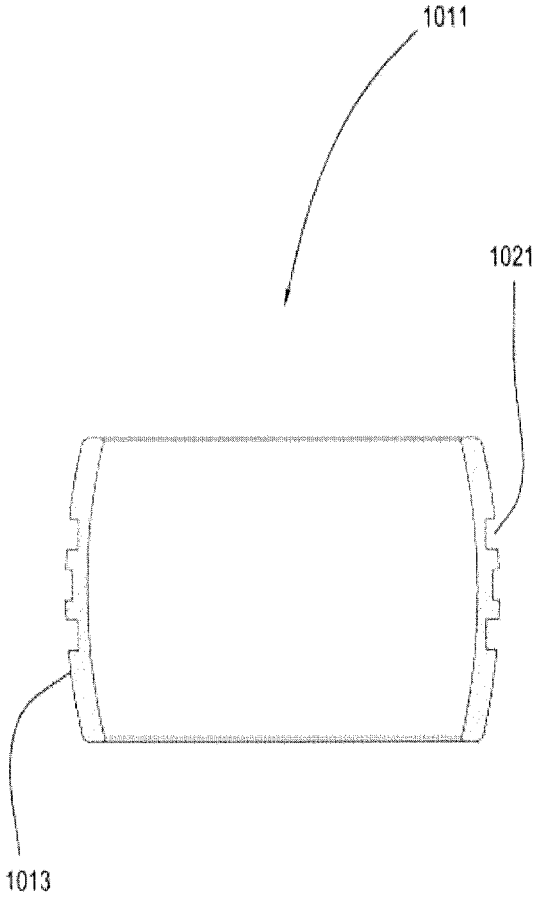
FIG. 10 shows a cross-sectional view of a retention mechanism according to embodiments of the present disclosure.

FIG. 10 discloses a cross section view of an embodiment of a compliant clamp 1011 wherein at least one groove 1021 may be machined annularly around an arcuate surface 1013 on the compliant clamp 1011. The groove 1021 may aid in preventing rotational and axial movement of a fixed cutting element, such as a pick. It is believed that having more than one groove may prevent the fixed cutting element from displacing axially and rotationally.

Figure 11:
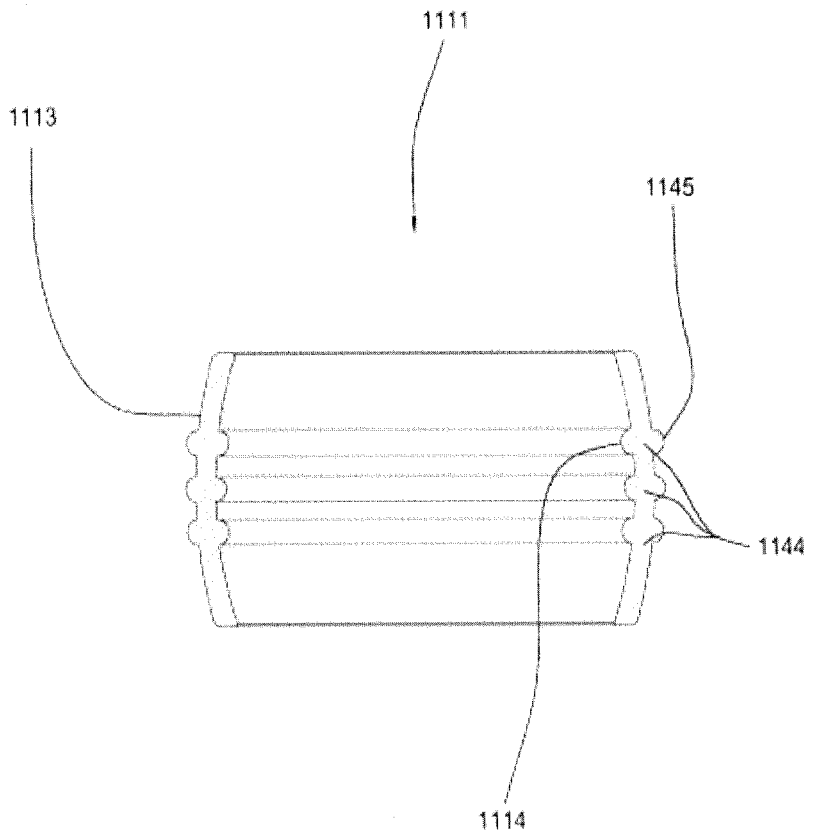
FIG. 11 shows a cross-sectional view of a retention mechanism according to embodiments of the present disclosure.

FIG. 11 discloses a cross section view of an embodiment of a compliant clamp 1111 wherein an arcuate surface 1113 may have an annular ring 1144. The annular ring 1144 may be formed on an outside surface 1145 and an inside surface 1114. The annular ring 1144 may prevent rotational and axial movement of a fixed cutting element, such as a pick. It is believed that having more than one annular ring 1144 may prevent the fixed cutting element from displacing axially and rotationally.

Figure 12:
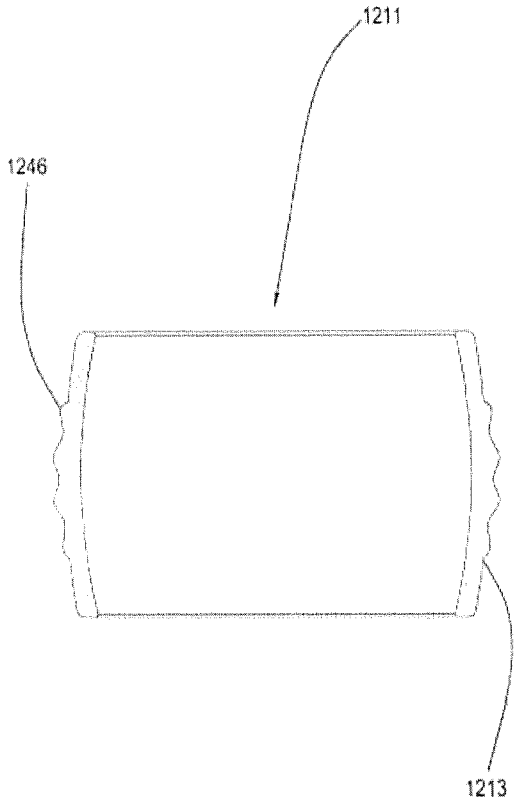
FIG. 12 shows a cross-sectional view of a retention mechanism according to embodiments of the present disclosure.

FIG. 12 discloses a cross section view of an embodiment of a compliant clamp 1211 wherein an arcuate surface 1213 may include an outward annular trough 1246. The outward annular trough 1246 may prevent rotational and axial movement of a fixed cutting element, such as a pick. It is believed that having more than one outward annular trough 1246 may inhibit or prevent the fixed cutting element from displacing axially and rotationally.

Figure 13:
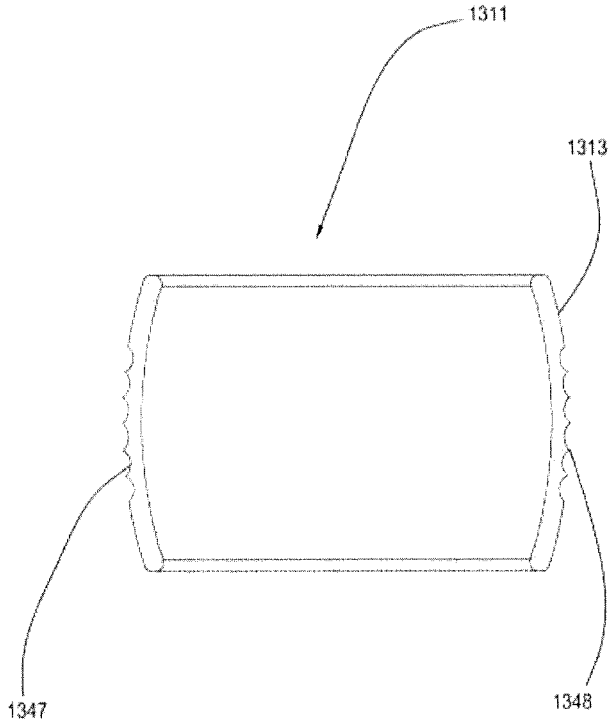
FIG. 13 shows a cross-sectional view of a retention mechanism according to embodiments of the present disclosure.

FIG. 13 discloses a cross section view of an embodiment of a compliant clamp 1311 wherein an arcuate surface 1313 may have an inward annular trough 1347. The compliant clamp 1311 may have more than one inward annular trough 1347. One trough 1347 may be adjacent to another trough 1347 such that the medium between the pair may be an annular ridge 1348. The compliant clamp having more than one trough 1347 may form one or more annular ridge 1348. The one or more annular ridge 1348 and one or more trough 1347 may inhibit or prevent rotational and axial movement of a fixed cutting element, such as a pick.

Figure 14A:
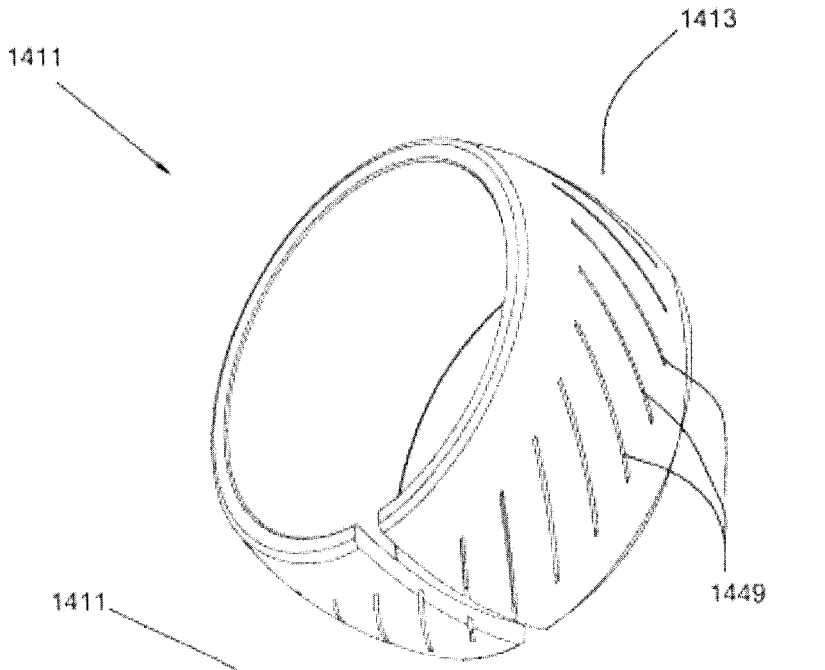
FIG. 14*a* shows a perspective view of a retention mechanism according to embodiments of the present disclosure.

FIG. 14*a* discloses a perspective view of an embodiment of a compliant clamp 1411 having an arcuate surface 1413. The arcuate surface 1413 may include a plurality of shallow cuts 1449.

Figure 14B:
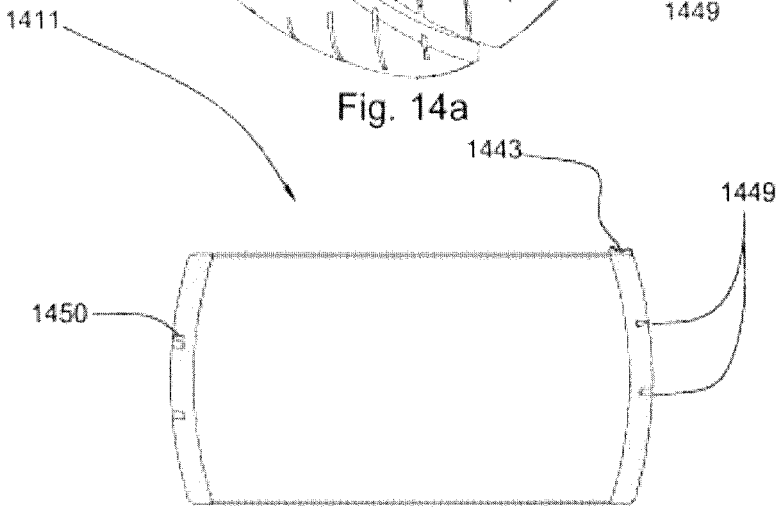
FIG. 14*b* shows a cross-sectional view of a retention mechanism according to embodiments of the present disclosure.

FIG. 14*b* discloses a cross section view of another embodiment of the compliant clamp 1411. The shallow cuts 1149 may not need to exceed a depth 1450 equivalent to a thickness 1443 of the compliant clamp. It is believed that the shallow cuts 1449 may inhibit or prevent rotational and axial movement of a fixed cutting element such as a pick.

FIG. 15*a* discloses a perspective view of an embodiment of a compliant clamp 1511 having an arcuate surface 1513. The arcuate surface 1513 may include a plurality of cuts 1551.

FIG. 15*b* discloses a cross section view of another embodiment of the compliant clamp 1511. The cuts 1551 may be a depth 1550 equivalent to a thickness 1543 of the compliant clamp. It is believed that the cuts 1551 may inhibit or prevent rotational and axial movement of a pick or other fixed cutting element.

Figure 16:
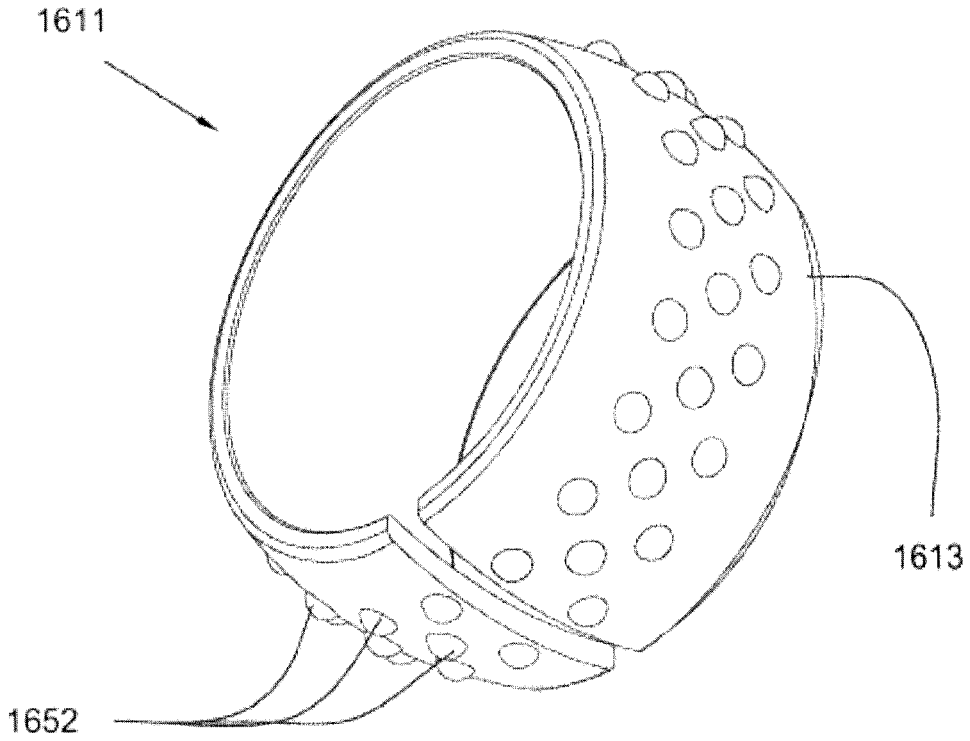
FIG. 16 shows a perspective view of a retention mechanism according to embodiments of the present disclosure.

FIG. 16 discloses a perspective view of an embodiment of a compliant clamp 1611 having an arcuate surface 1613. The arcuate surface 1613 may include a plurality of bumps 1652. The bumps 1652 may be hemispherical and may exist externally on the arcuate surface 1613, internally on the arcuate surface 1613, or a combination thereof. It is believed that the bumps 1552 may inhibit or prevent rotational and axial movement of a pick or other fixed cutting element. The bumps 1552 may exist as cones, cylinders, squares, stars and the like.

Figure 17A:
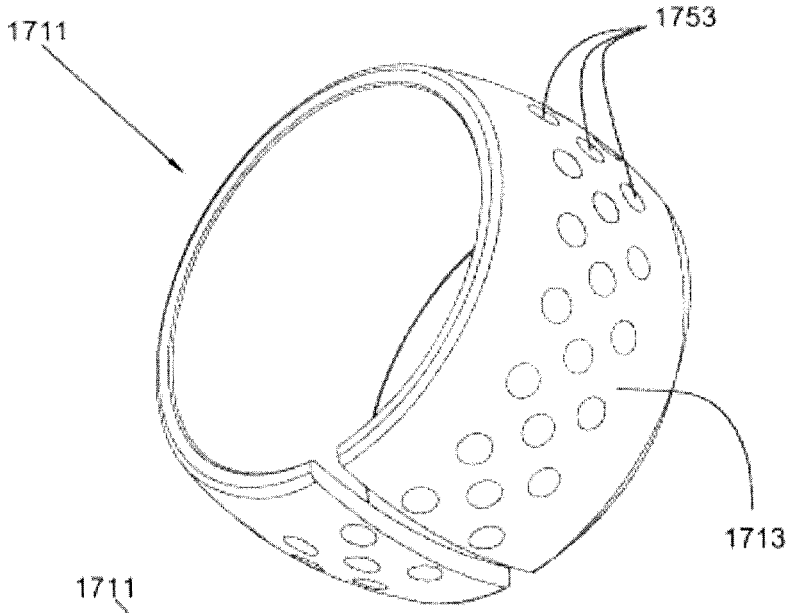
FIG. 17*a* shows a perspective view of a retention mechanism according to embodiments of the present disclosure.

FIG. 17*a* discloses a perspective view of an embodiment of a compliant clamp 1711 having an arcuate surface 1713. The arcuate surface may have a plurality of dimples 1753.

Figure 17B:
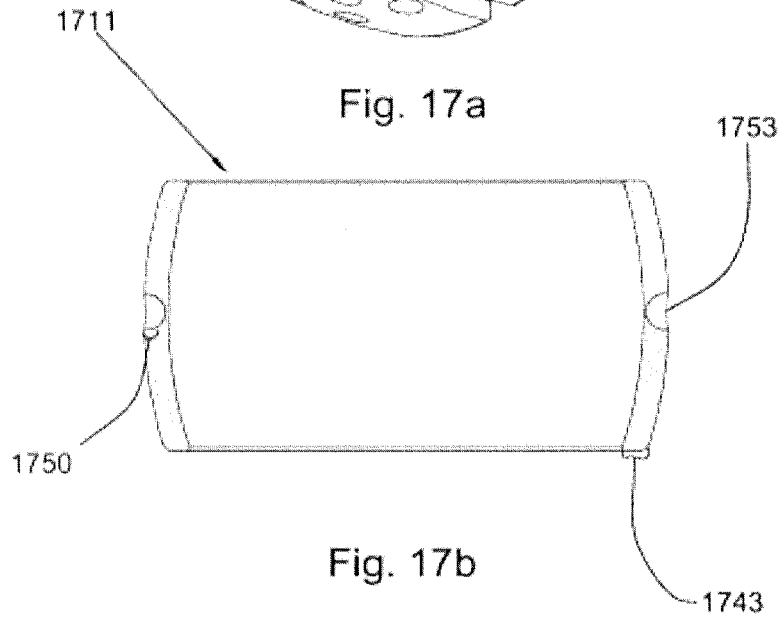
FIG. 17*b* shows a cross-sectional view of a retention mechanism according to embodiments of the present disclosure.

FIG. 17*b* discloses a cross section view of another embodiment of the compliant clamp 1711. The dimples 1753 may be machined a depth 1750 which may or may not exceed the thickness 1743 of the compliant clamp. It is believed that the dimples 1753 may inhibit or prevent rotational and axial movement of a pick 1705 or other fixed cutting element.

FIGS. 18*a*, 18*b*, 18*c*, 18*d*, 18*e*, and 18*f* disclose a structure and method for installing a compliant clamp to the shank of a pick.

Figure 18A:
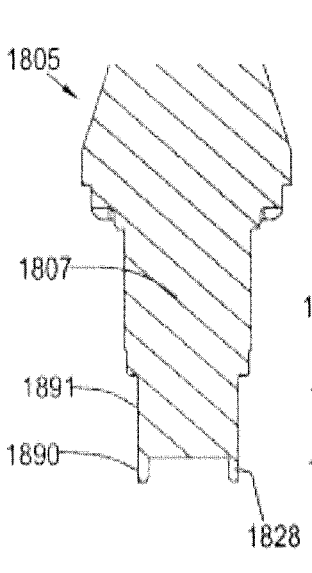
FIGS. 18*a*-18*f* show a method of assembling a retention mechanism to a cutting element according to embodiments of the present disclosure.

FIG. 18*a* discloses a pick 1805 having a shank 1807. The shank 1807 has an annular rim 1828. The shank 1807 and the annular rim 1828 may have an outside diameter. The outside diameter of the shank 1891 may be substantially similar to the outside diameter of the annular rim 1890.

Figure 18B:
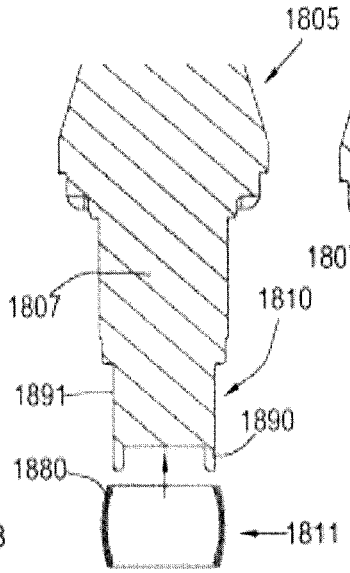

FIG. 18*b* discloses the pick 1805 having the shank 1807 and a compliant clamp 1811. An inside diameter 1880 of the compliant clamp may be substantially the same as or greater than the outside diameter 1891 of the shank and the outside diameter 1890 annular rim so that the compliant clamp 1811 may slide axially onto the shank 1807. The compliant clamp 1811 may slide axially onto an annular recess 1810 of the shank.

Figure 18C:
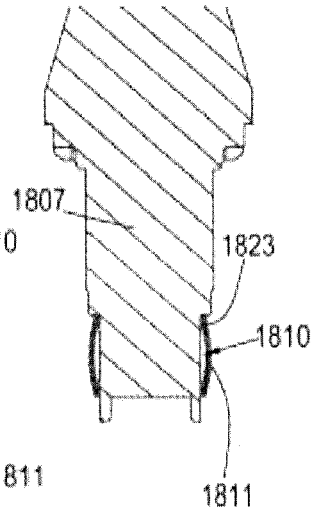

FIG. 18*c* discloses the compliant clamp 1811 slid axially onto the shank 1807. The compliant clamp 1811 may be slid such that an end of the compliant clamp 1811 contacts a top race 1823 of the annular recess 1810 of the shank.

Figure 18D:
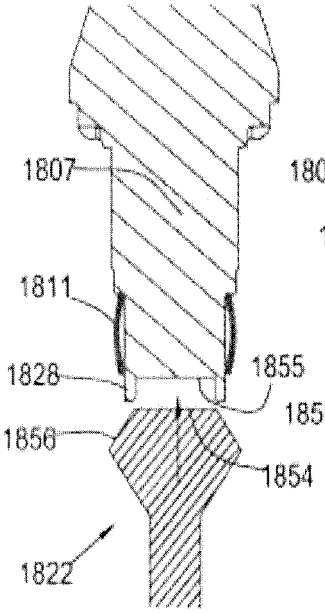

FIG. 18*d* discloses the shank 1807 having the compliant clamp 1811 and a tool 1822. The tool 1822 may apply force to the shank 1807 to bend the annular rim 1828. The tool 1822 may have a front face 1854. The front face 1854 may be disposed coplanar with a bottom surface 1855 of the shank 1807 as the tool 1822 applies force to bend the annular rim 1828. The tool 1822 may also have a forming surface 1856. The forming surface 1856 applies force to the annular rim 1828 during bending.

Figure 18E:
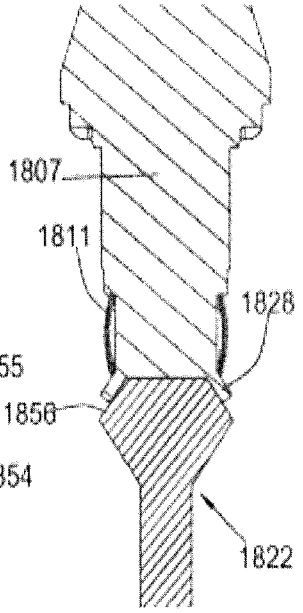

FIG. 18*e* discloses the tool 1822 and the shank 1807. The tool 1822 may bend the annular rim 1828 of the shank to retain the compliant clamp 1811. The annular rim 1828 may bend to an angle of the forming surface 1856. The angle of the forming surface 1856 may be less than ninety degrees. In some embodiments, the forming surface 1856 may have an angle such that the annular rim 1828 is bent substantially forty-five degrees.

Figure 18F:
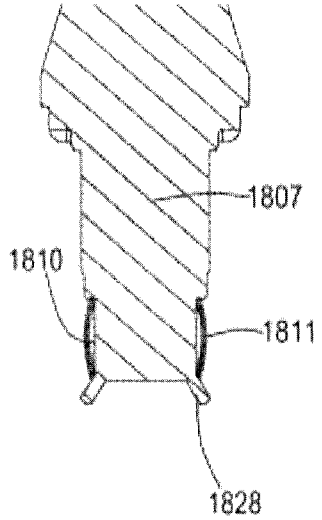

FIG. 18*f* discloses the shank 1807 and the compliant clamp 1811. The annular rim 1828 is bent to retain the compliant clamp 1811. The bent annular rim 1828 may prevent the compliant clamp 1811 from sliding axially along the annular recess 1810.

Figure 19:
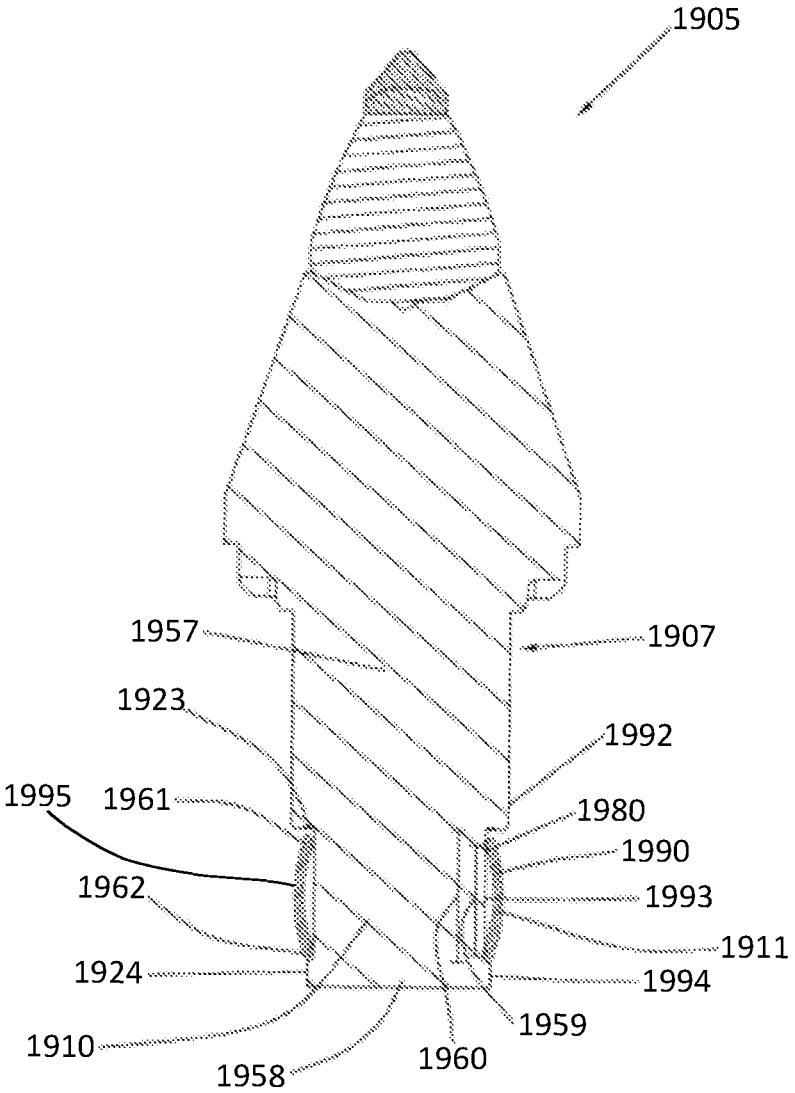
FIG. 19 shows a cross-sectional view of a cutting element and retention mechanism according to embodiments of the present disclosure.

FIG. 19 discloses a pick 1905 and a compliant clamp 1911. The pick 1905 has a shank 1907. The shank 1907 is configured to fit in a receiving element, or support. The shank 1907 includes a top section 1957 having a first diameter 1992, an annular recess 1910 section having a second diameter 1993 and a bottom section 1958 having a third diameter 1994. In this embodiment, the first diameter 1992 is greater than the second diameter 1993 and the third diameter 1994, and the second diameter 1993 is less than the first diameter 1992 and the third diameter 1994.

The compliant clamp 1911 may be disposed on the annular recess 1910 between a top race 1923 and a bottom race 1924. An axial length 1959 of the compliant clamp may be less than an axial length 1960 of the annular recess to allow the compliant clamp 1911 to extend axially when the compliant clamp 1911 is compressed laterally. Extending the compliant clamp 1911 axially may cause a top end 1961 of the compliant clamp to make contact with the top race 1923 and a bottom end 1962 to make contact with the bottom race 1924, thereby, securing the compliant clamp 1911 and preventing the compliant clamp 1911 from sliding axially. The compliant clamp 1911 may have an inner diameter 1980 greater than the third diameter 1994 to allow the compliant clamp to slide over the bottom section 1958 to the annular recess 1910. As a result, an outer diameter 1995 of the compliant clamp may be too great to fit inside a bore of the receiving element, and therefore, the compliant clamp is made of a compressible material to allow the compliant clamp to compress to a diameter of the bore of the receiving element. The compliant clamp 1911 may be compressed laterally when the pick 1905 is installed into the receiving element.

Figure 20:
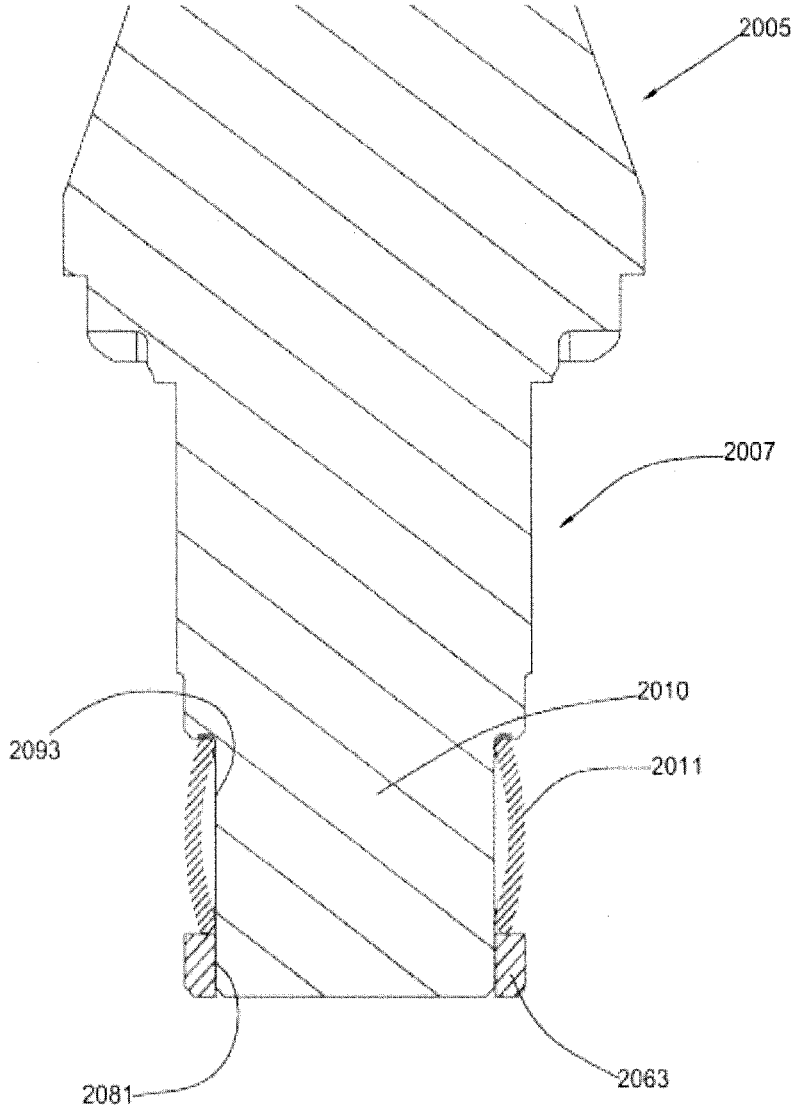
FIG. 20 shows a cross-sectional view of a cutting element and retention mechanism according to embodiments of the present disclosure.

FIG. 20 discloses a pick 2005 and a compliant clamp 2011. The compliant clamp 2011 may be disposed around a shank 2007 of the pick. The compliant clamp 2011 may be disposed in an annular recess 2010 of the shank. A retention sleeve 2063 may be attached to the shank 2007. The compliant clamp 2011 may be disposed between a top race 2023 and the retention sleeve 2063. The retention sleeve 2063 may prevent the compliant clamp 2011 from sliding axially. An inside diameter 2081 of the retention sleeve 2063 may be the same or greater than an outside diameter 2093 of the annular recess 2010.

Figure 21:
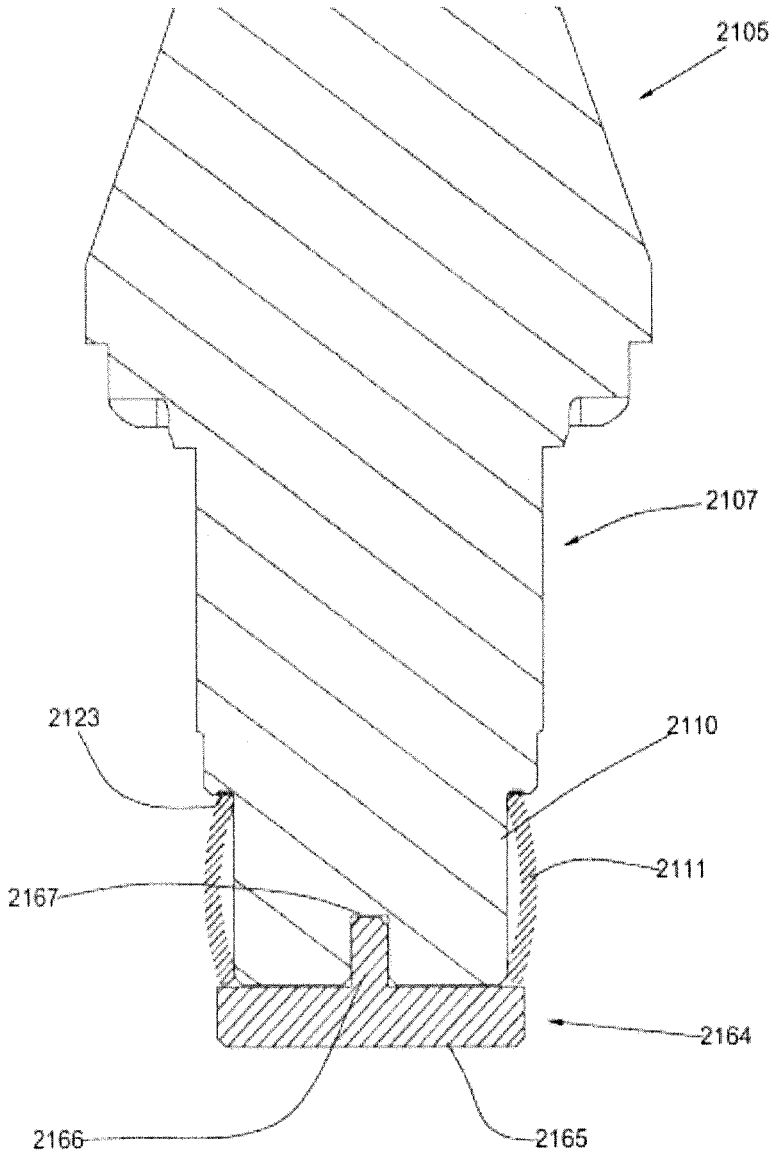
FIG. 21 shows a cross-sectional view of a cutting element and retention mechanism according to embodiments of the present disclosure.

FIG. 21 discloses a pick 2105 and a compliant clamp 2111. The compliant clamp 2111 may be disposed around a shank 2107 of the pick. The compliant clamp 2111 may be disposed in an annular recess 2110 of the shank. A retention cap 2164 may be attached to the shank 2107. The compliant clamp 2111 may be disposed between a top race 2123 and the retention cap 2164. The retention cap 2164 may prevent the compliant clamp 2111 from sliding axially. The retention cap 2164 may have a base portion 2165 and a protruding portion 2166. The protruding portion 2166 may fit in a slot 2167 of the shank. The protruding portion 2166 may be press fit into the slot 2167. The protruding portion 2166 and slot 2167 may have circular or polygonal cross sections. Having a polygonal cross section may prevent the retention cap 2164 from rotating with respect to the shank 2107. The base portion 2165 may have an outside diameter greater than an outside diameter of the annular recess to form a bottom race. The bottom race may prevent the compliant clamp 2111 from sliding along the annular recess 2110 of the shank.

Figure 22:
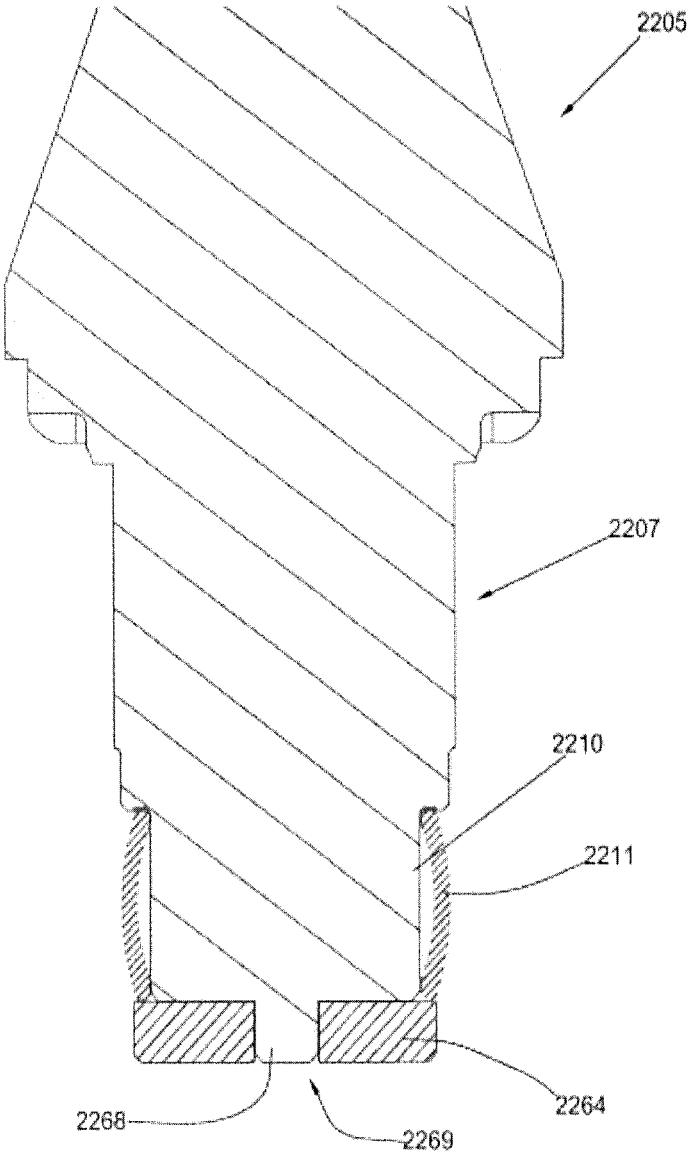
FIG. 22 shows a cross-sectional view of a cutting element and retention mechanism according to embodiments of the present disclosure.

FIG. 22 discloses a pick 2205 and a compliant clamp 2211. The compliant clamp 2211 may be disposed around a shank 2207 of the pick. The compliant clamp 2211 may be disposed in an annular recess 2210 of the shank. A retention cap 2264 may be attached to the shank. The compliant clamp 2211 may be disposed between a top race 2223 and the retention cap 2264. The retention cap 2264 may prevent the compliant clamp 2211 from sliding axially. The shank 2207 may have a protruding portion 2268. The protruding portion 2268 may fit in a slot 2269 of the compliant clamp 2211. The compliant clamp 2211 may be press fit onto the protruding portion 2268. The protruding portion 2268 and slot 2269 may have circular or polygonal cross sections. Having a polygonal cross section may prevent the retention cap 2264 from rotating with respect to the shank 2207. The retention cap 2264 may have an outside diameter greater than an outside diameter of the annular recess 2210 to form a bottom race 2224. The bottom race 2224 may prevent the compliant clamp 2211 from sliding along the annular recess 2210 of the shank.

Retention of Rotatable Cutting Elements

Retention mechanisms such as the ones described above used with fixed cutting elements may also be used with rotatable cutting elements. Unlike the cutting element assemblies described above that include a retention mechanism clamped around a fixed cutting element to axially and rotationally fix the cutting element within a support structure, rotatable cutting elements may be designed to rotate within a support structure. A cutting element retained by a retention mechanism according to embodiments of the present disclose may be designed to be rotatable within a support, for example, by including a ball bearing system radially between the retention mechanism and the support, by adding a low friction material to the cutting element and/or support, and/or by modifying the shape and orientation of the cutting face of the cutting element. Other structures, materials, or other ways of reducing friction between a cutting element and support may be used alone or in combination to design a cutting element assembly having a rotatable cutting element retained with a retention mechanism of the present disclosure.

Figure 41:
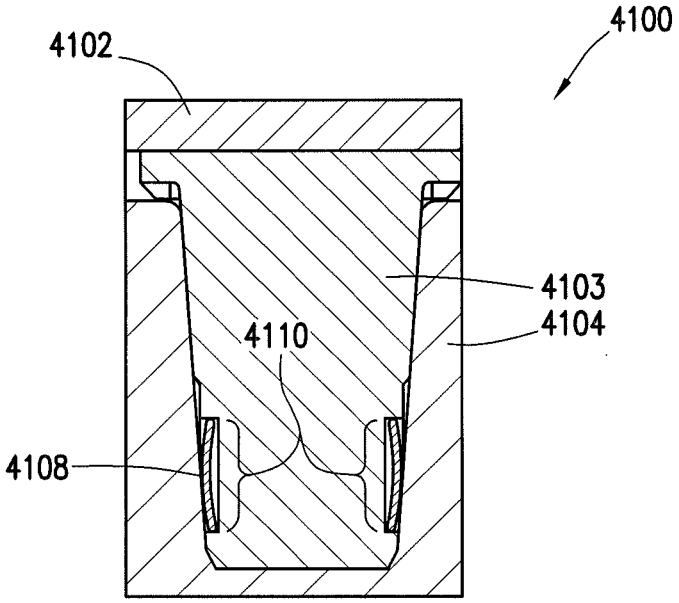
FIG. 41 shows a cross-sectional view of a cutting element assembly according to embodiments of the present disclosure.

Referring now to FIG. 41, a cross-sectional view of a cutting assembly 4100 is shown. Cutting element assembly 4100 includes a cutting element 4102 partially disposed in a sleeve 4104, or support, which may be brazed or otherwise affixed to a blade of a cutting tool, such as a drill bit or other downhole cutting tool (not shown). The cutting element 4102 may be retained in the sleeve 204 by a retention mechanism (referred to above as a compliant clamp) 4108 disposed in a circumferential groove 4110 formed within the shank or shaft 4103 of the cutting element 4102. The retention mechanism 4108 may include an arcuate or bow-like cross-section and may include a metallic material such as steel. The circumferential retention mechanism 4108 may aid in preventing axial movement of the cutting element while remaining simple to install and remove. As mentioned above, rotation of the cutting element 4102 within the sleeve may be achieved by overcoming the frictional force that would otherwise keep the cutting element from rotating. Overcoming the frictional force may be achieved, for example, by modification of one or more surfaces with which the compliant clamp interfaces and/or orienting the cutting element (with respect to the material being cut) in a manner such that a side cutting force is generated that may exceed the frictional force. Such modifications of the surfaces (of the sleeve and/or shaft of the cutting element) may include one or more lubricious materials, such as diamond, to reduce the coefficient of friction therebetween. The components may be formed of such materials in their entirely or have portions of the components including such lubricious materials deposited on the component, such as by chemical plating, chemical vapor deposition (CVD) including hollow cathode plasma enhanced CVD, physical vapor deposition, vacuum deposition, arc processes, or high velocity sprays). Other embodiments may include a ball bearing system adjacent to the retention mechanism to reduce the frictional forces between the cutting element, the retention mechanism, and/or the sleeve.

Figure 42:
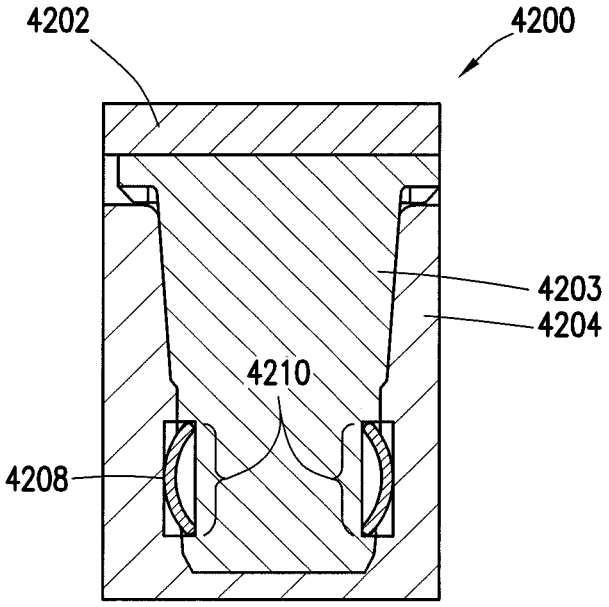
FIG. 42 shows a cross-sectional view of a cutting element assembly according to embodiments of the present disclosure.

Referring now to FIG. 42, a cross-sectional view of a cutting assembly 4200 is shown. Cutting element assembly 4200 includes a cutting element 4202 partially disposed in a sleeve 4204, or support, which may be brazed or otherwise affixed to a blade of a cutting tool, such as a drill bit or other downhole cutting tool (not shown). The cutting element 4202 may be retained in the sleeve 4204 by a retention mechanism (referred to above as a compliant clamp) 4208 disposed in a circumferential groove 4210 formed within the shank or shaft 4203 of the cutting element 4202 and/or within circumferential groove 4212 formed within inner surface of sleeve 4204. While the grooves 4210 and 4212 are illustrated as being rectangular in cross-section, it is also envisioned that grooves 4210 and/or 4212 may have a varying diameter along the axial extent thereof. Such varying diameter may be achieved, for example, through incorporated a curvature along the axial direction (such as mimicking the curvature of the retention mechanism 4208) or by including a taper at either axial end of the groove.

Figure 23:
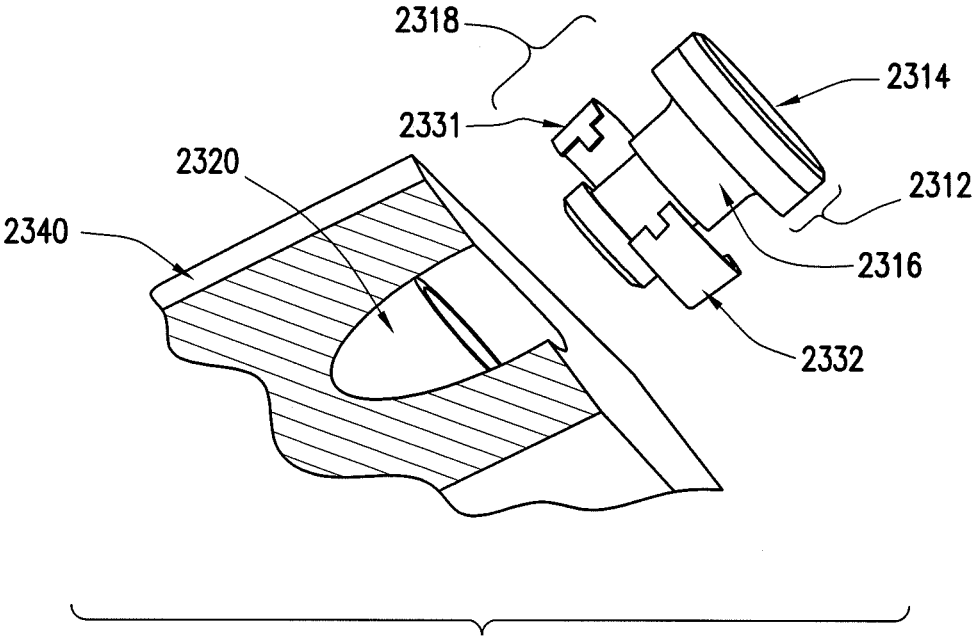
FIGS. 23 and 24 show a perspective view and a cross sectional view, respectively, of a cutting element assembly according to embodiments of the present disclosure.
Figure 24:
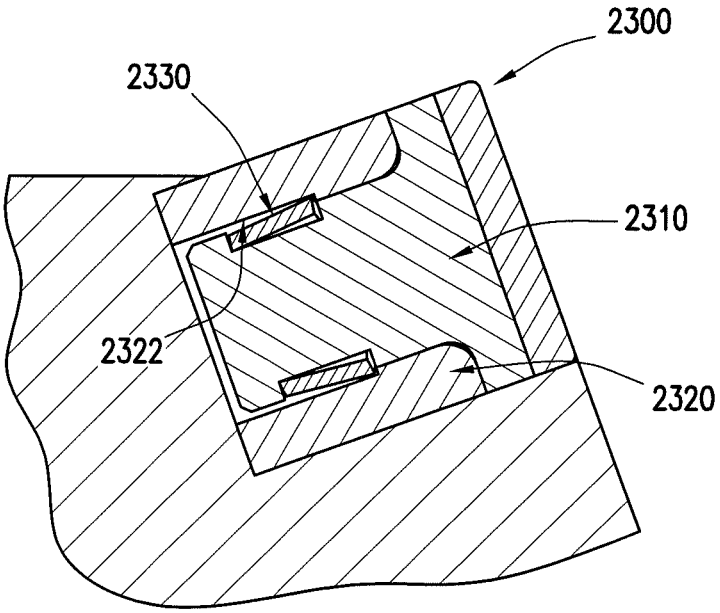

Referring now to FIGS. 23 and 24, a perspective view and a cross-sectional view, respectively, of a cutting element assembly 2300 according to embodiments of the present disclosure is shown. The cutting element assembly 2300 includes a cutting element 2310 partially disposed within a support 2320 and a retention mechanism 2330 disposed between the cutting element 2310 and the support 2320. The cutting element 2310 shown includes a cutting end 2312 having a planar cutting face 2314 and a body 2316, where a portion of the body having a diameter smaller than the diameter of the cutting face 2314 is referred to as a shaft 2318. As shown in FIG. 23, the retention mechanism 2330 includes two pieces, a first piece 2331 and a second piece 2332, where the two pieces are interlocked around the circumference of the cutting element 2310 to form a complete ring around the shaft portion of the cutting element. However, in some embodiments, more than two pieces may be assembled around a cutting element to form the retention mechanism. The cutting element 2310 and the retention mechanism 2330 may be pushed into a support 2320, where the support 2320 forms a sleeve around both the retention mechanism and the shaft 2316 portion of the cutting element 2310. As shown, the support sleeve 2320 is disposed around the cutting element 2310 and axially extends a partial height along the cutting element 2310.

The cutting element assembly 2300 may be attached within a pocket formed on a cutting tool 2340, positioned such that the cutting force exerted at an edge of the cutting face 2314 during operation may rotate the cutting element 2310 within the support 2320. Particularly, the support 2320 is attached within the pocket. The inner surface 2322 of the support 2320 includes multiple inner diameters, where once the cutting element and retention mechanism are inserted into the support, the retention mechanism expands radially to contact the inner surface 2322 at a portion with a larger diameter and is prevented from sliding axially out of the support by a portion with a relatively smaller diameter. As shown, a portion of the support having a relatively smaller inner diameter may form a step which blocks the retention mechanism from sliding out of the support.

Figure 25:
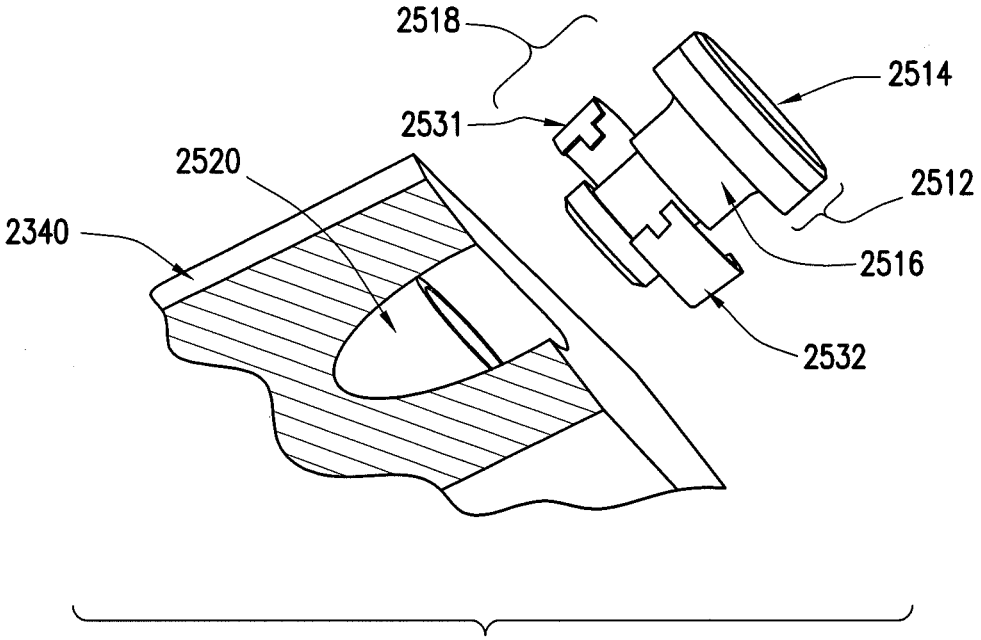
FIGS. 25 and 26 show a perspective view and a cross sectional view, respectively, of a cutting element assembly according to embodiments of the present disclosure.
Figure 26:
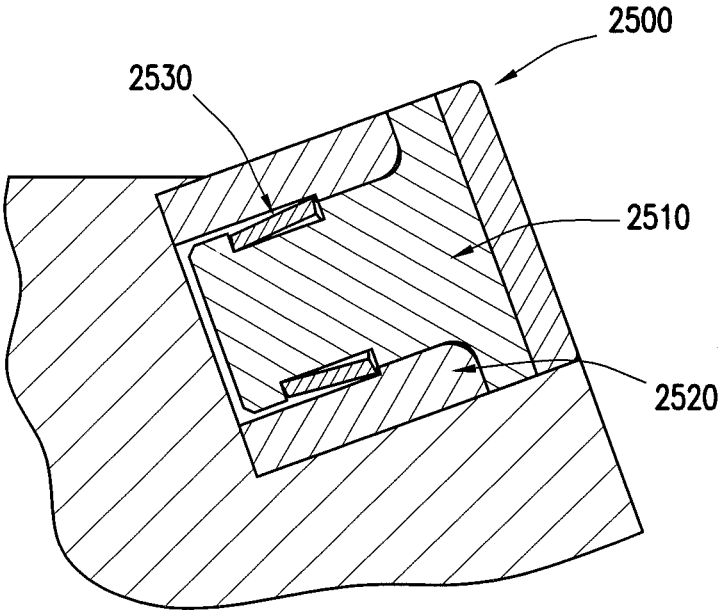

As shown in FIGS. 25 and 26, a cutting element assembly 2500 according to embodiments of the present disclosure may include a cutting element 2510 partially disposed within a support 2520 and a retention mechanism 2530 disposed between the cutting element 2510 and the support 2520. The cutting element 2510 shown includes a cutting end 2512 having a cutting face 2514 and a body 2516, where a portion of the body having a diameter smaller than the diameter of the cutting face 2514 is referred to as a shaft 2518. As shown in FIG. 25, the retention mechanism 2530 includes two pieces, a first piece 2531 and a second piece 2532, where the two pieces are interlocked around the circumference of the cutting element 2510 to form a complete ring around the shaft portion of the cutting element. The cutting element 2510 and the retention mechanism 2530 may be pushed into a support 2520, where the support 2520 is a pocket formed in a cutting tool 2540 body. The pocket extends around the circumference of both the retention mechanism and the shaft 2316 portion of the cutting element 2310 and extends axially along the cutting element 2510 at least the axial distance of the shaft 2518 portion of the cutting element 2510.

Figure 27:
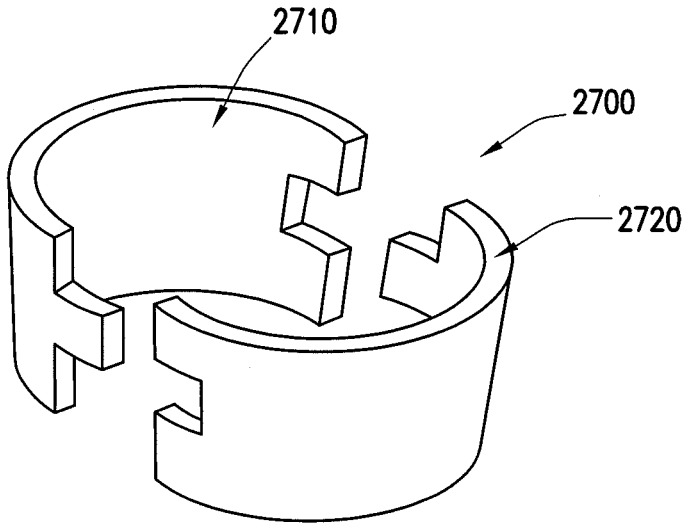
FIGS. 27 and 28 show a perspective view and a side view, respectively, of a retention mechanism according to embodiments of the present disclosure.
Figure 28:
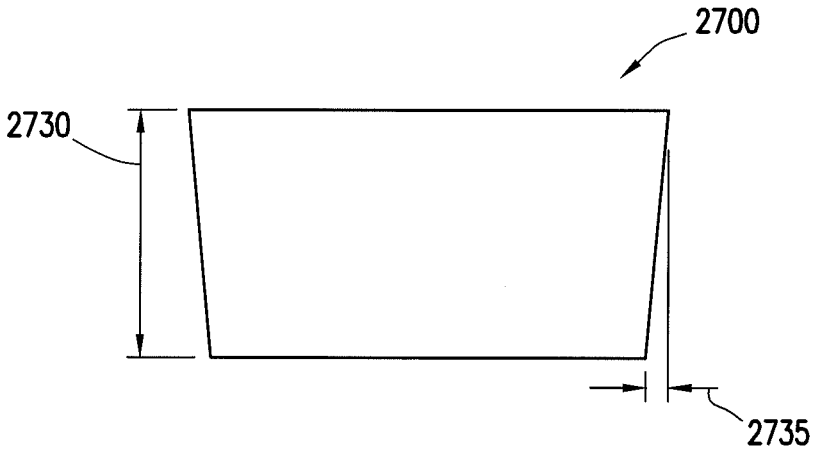

FIGS. 27 and 28 show a perspective view and a side view, respectively, of a retention mechanism according to embodiments of the present disclosure. The retention mechanism 2700 has a first piece 2710 and a second piece 2720 that interlock together to form a truncated conical shaped ring. The retention mechanism 2700 may be formed of a ductile material such as a metallic alloy, where both the axial and radial dimensions of the retention mechanism are flexible. For example, as shown in FIG. 28, an axial dimension 2730 may increase and decrease upon assembly, and a radial dimension 2735 may increase and decrease upon assembly. The deformation of the radial dimension 2735 may be related to the deformation of the axial dimension 2730. For example, as the retention mechanism 2700 is inserted into a support, the radial dimension may be compressed and axial dimension may increase. As the retention mechanism locks into a race or larger diameter of a support, the radial dimension may expand toward the inner surface of the support and the axial dimension may decrease.

Figure 29:
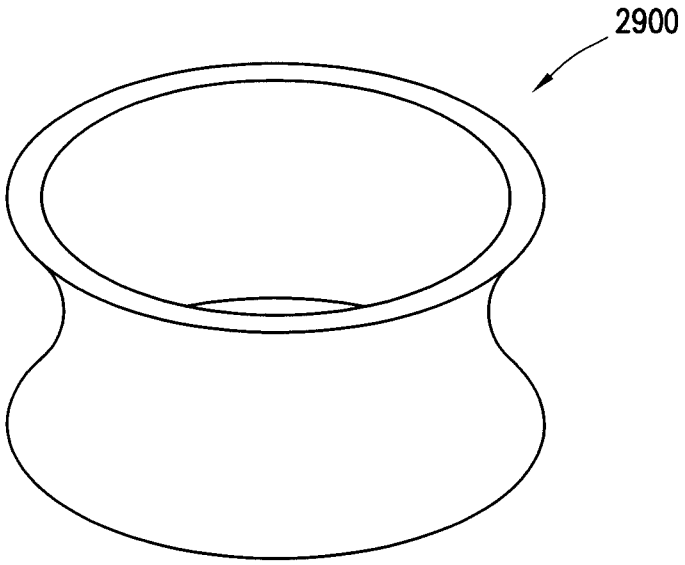
FIGS. 29 and 30 show a perspective view and a side view, respectively, of a retention mechanism according to embodiments of the present disclosure.
Figure 30:
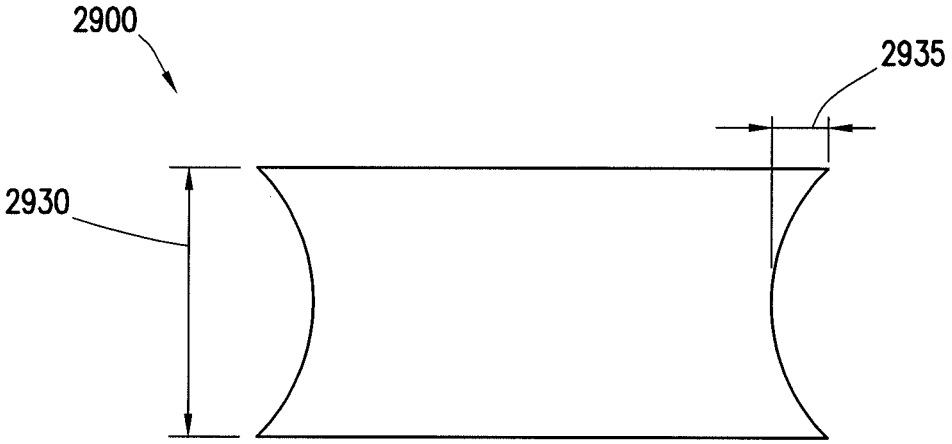

FIGS. 29 and 30 show a perspective view and a side view, respectively, of another retention mechanism 2900 according to embodiments of the present disclosure. The retention mechanism 2900 has an arcuate cross sectional shape, where the outer surface is concave. However, in some embodiments, a retention mechanism may have an arcuate cross-sectional shape where the outer surface is convex. Further, the retention mechanism 2900 has an axial dimension 2930 that may increase and decrease upon assembly, and a radial dimension 2935 may increase and decrease upon assembly. The deformation of the radial dimension 2935 may be related to the deformation of the axial dimension 2930. For example, as the retention mechanism 2900 is inserted into a support, the radial dimension may be compressed and axial dimension may increase. As the retention mechanism locks into a race or larger diameter of a support, the radial dimension may expand toward the inner surface of the support and the axial dimension may decrease.

Figure 31:
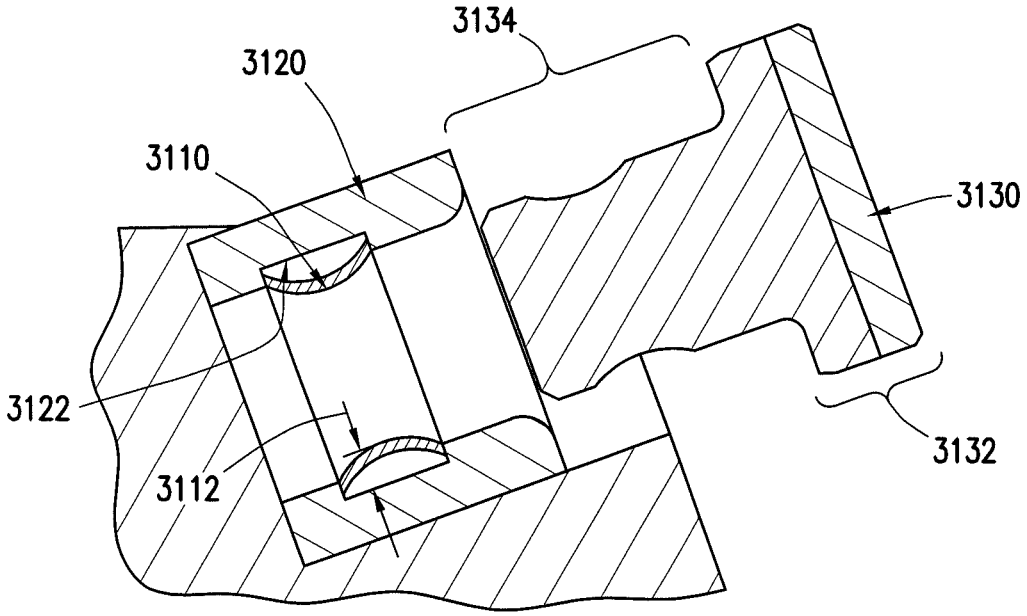
FIGS. 31 and 32 show cross sectional views of assembly of a cutting element assembly according to embodiments of the present disclosure.
Figure 32:
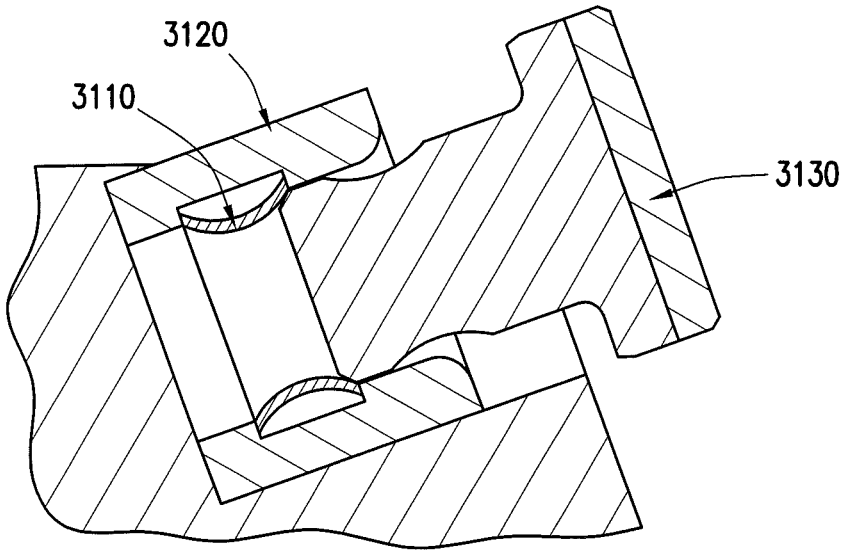

However, in other embodiments, the retention mechanism may deform such that the radial dimension (and not the axial dimension) increases or decreases. For example, FIGS. 31 and 32 show a method of assembling a cutting element assembly according to embodiments of the present disclosure, where upon assembly, the retention mechanism deforms from a change in its radial dimension. As shown, a retention mechanism 3110 is inserted within a race 3122 formed annularly around the inner surface of a support 3120. The retention mechanism 3110 has an arcuate cross-sectional shape, where the arc is concave along its radial dimension, and where the axial dimension of the retention mechanism 3110 extends the entire height of the race 3122. A rotatable cutting element 3130 having a cutting end 3132 and a shaft 3134, where the diameter of the cutting end is larger than the diameter of the shaft, is inserted into the support 3120 and the retention mechanism 3110. As the cutting element is inserted through the retention mechanism 3110, the retention mechanism deforms, such that its radial dimension 3112 decreases.

Figure 33:
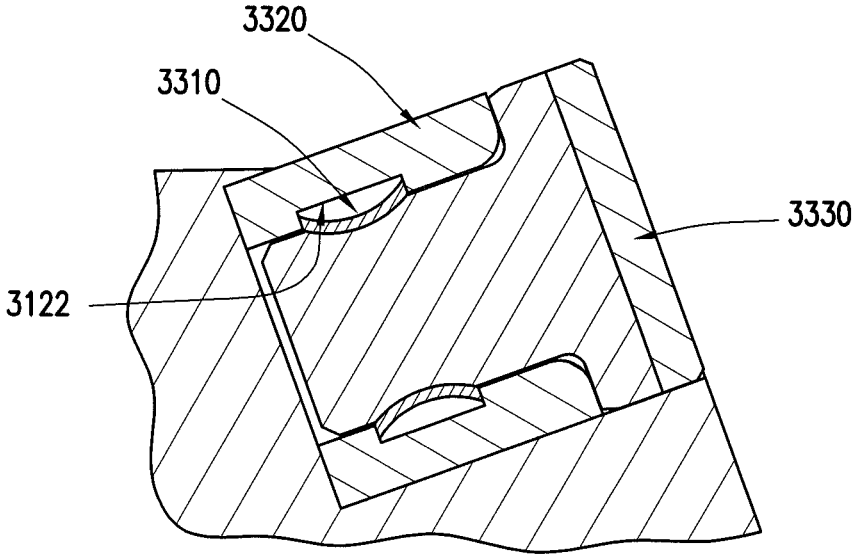
FIG. 33 shows a cross-sectional view of a cutting element assembly according to embodiments of the present disclosure.

As shown in FIG. 33, a support may be a sleeve 3320 extending around a retention mechanism 3310 and a shaft portion of a cutting element 3330. The sleeve 3320 may have an annular recess formed around its inner surface, where the retention mechanism 3310 is disposed within the annular recess. The retention mechanism 3310 has an axial dimension extending the entire height of the annular recess and a radial dimension extending from the annular recess to contact the cutting element 3330. As shown, the cutting element shaft may have an annular recess corresponding in shape with the mating shape of the retention mechanism 3310. Annular recesses formed within a support and/or around a shaft portion of a cutting element may have stepped or angular top race and bottom race portions, or may have curved top race and/or bottom race portions. As shown, the annular recess formed in the support sleeve 3320 has a stepped top race and bottom race, and the annular recess formed around the shaft portion of the cutting element 3330 has a curved transition forming its top and bottom races.

Figure 34:
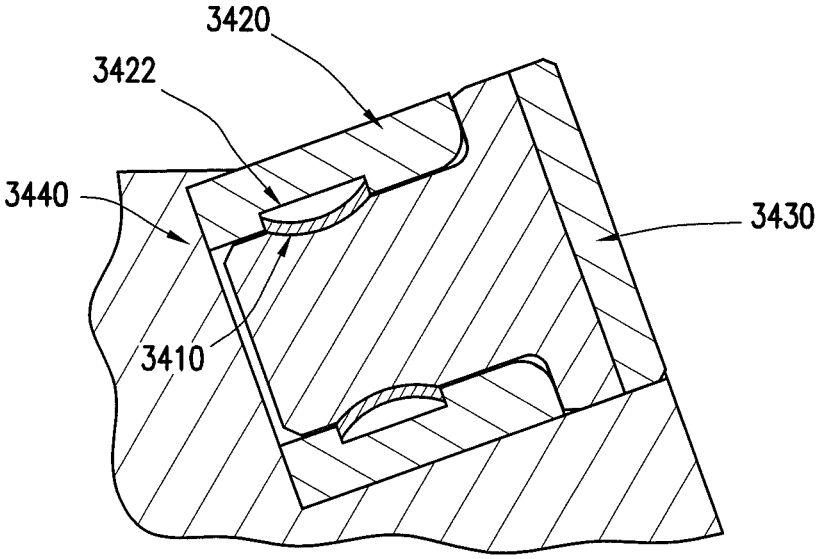
FIG. 34 shows a cross-sectional view of a cutting element assembly according to embodiments of the present disclosure.

FIG. 34 shows a cutting element assembly 3400 including a cutting element 3430 partially disposed within a support 3420 and a retention mechanism 3410 disposed between the cutting element 3430 and the support 3420. The retention mechanism 3410 has an arcuate cross-sectional shape, where the radial dimension of the retention mechanism is deformable. The support 3420 is a cutting tool 3440 body, where the retention mechanism 3410 and cutting element 3430 are inserted into a pocket formed in the cutting tool 3440.

Figure 35:
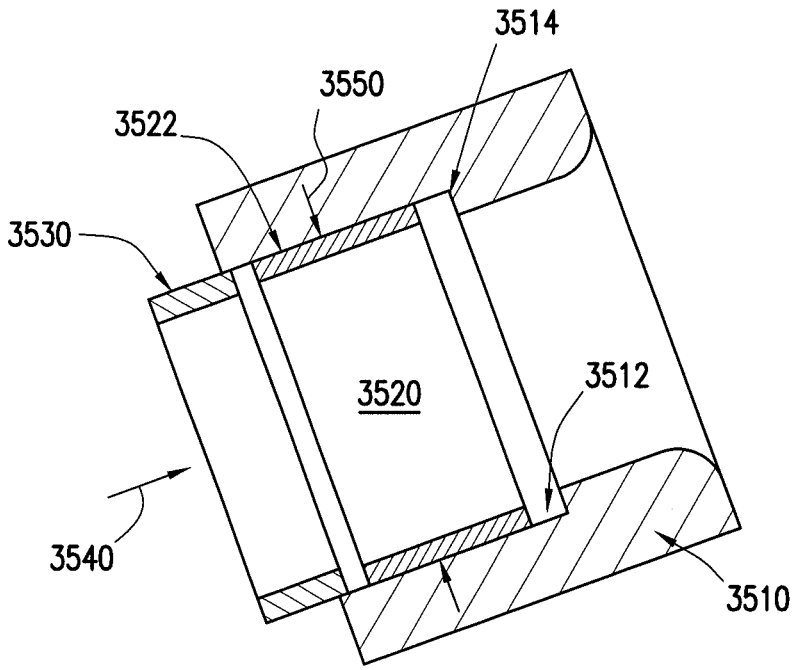
FIGS. 35 and 36 show cross sectional views of assembly of a retention mechanism within a support according to embodiments of the present disclosure.
Figure 36:
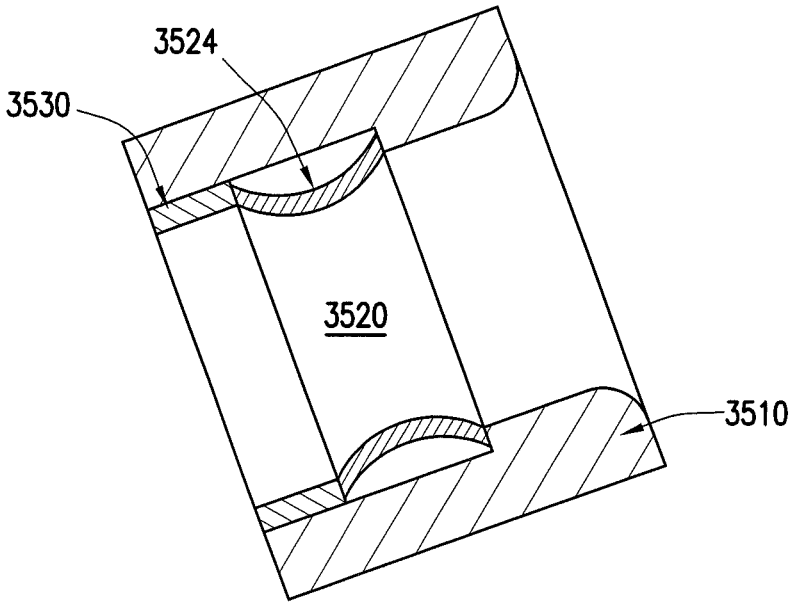

Referring now to FIGS. 35 and 36, a method of assembling a cutting element assembly according to embodiments of the present disclosure is shown. A support 3510 has an annular recess 3512 formed around its inner surface. The annular recess 3512 has a stepped transition 3514 from a relatively larger diameter to a relatively smaller diameter. A retention mechanism 3520 having a cylindrical ring shape is inserted into the annular recess 3512, where the outer diameter of the retention mechanism substantially corresponds with the inner diameter of the annular recess 3512. A retention cap 3530 is pushed 3540 against a base of the retention mechanism 3520 such that the radial dimension 3550 deforms from a planar cross-sectional shape 3522 to an arcuate cross-sectional shape 3524. As the radial dimension 3550 increases from its planar cross-sectional shape 3522 to its arcuate cross-sectional shape 3524, the axial dimension decreases. Further, the retention cap 3530 may have a size and shape such that at least a portion of the retention cap 3530 fits within the annular recess 3512 of the support. For example, as shown in FIG. 36, the entire retention cap 3530 may fit within the annular recess 3512.

Figure 37:
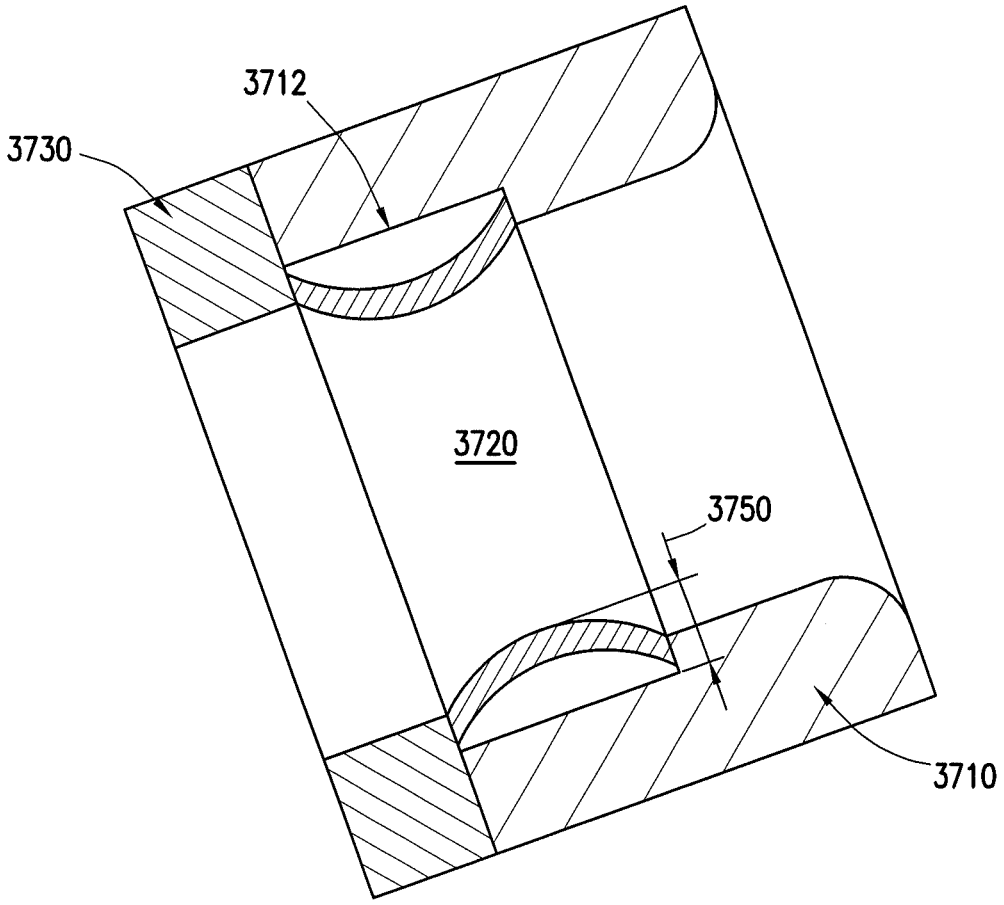
FIG. 37 shows a cross-sectional view of a retention mechanism disposed within a support according to embodiments of the present disclosure.

However, as shown in FIG. 37, a retention cap 3730 may have a size and shape such that no portion of the retention cap 3730 fits within an annular recess 3712. In such embodiments, the retention cap 3730 may push a retention mechanism 3720 into an annular recess 3712 of a support 3710 such that the radial dimension 3750 of the retention mechanism 3720 deforms from a planar cross-sectional shape to an arcuate cross-sectional shape and a base of the retention mechanism 3520 aligns with a base of the support 3710. As the radial dimension 3750 increases from its planar cross-sectional shape to its arcuate cross-sectional shape, the axial dimension decreases.

According to embodiments of the present disclosure, a cutting element may have a retention mechanism attached at its base. For example, a cutting element may include a cutting end having a cutting face, a body, and a retention end opposite the cutting end. The retention end may have at least one slit extending an axial distance along a partial height of the retention end and extending a transverse distance between the outer circumference of the retention end. The retention end may be formed of a different material than the body of the cutting element.

Figure 38:
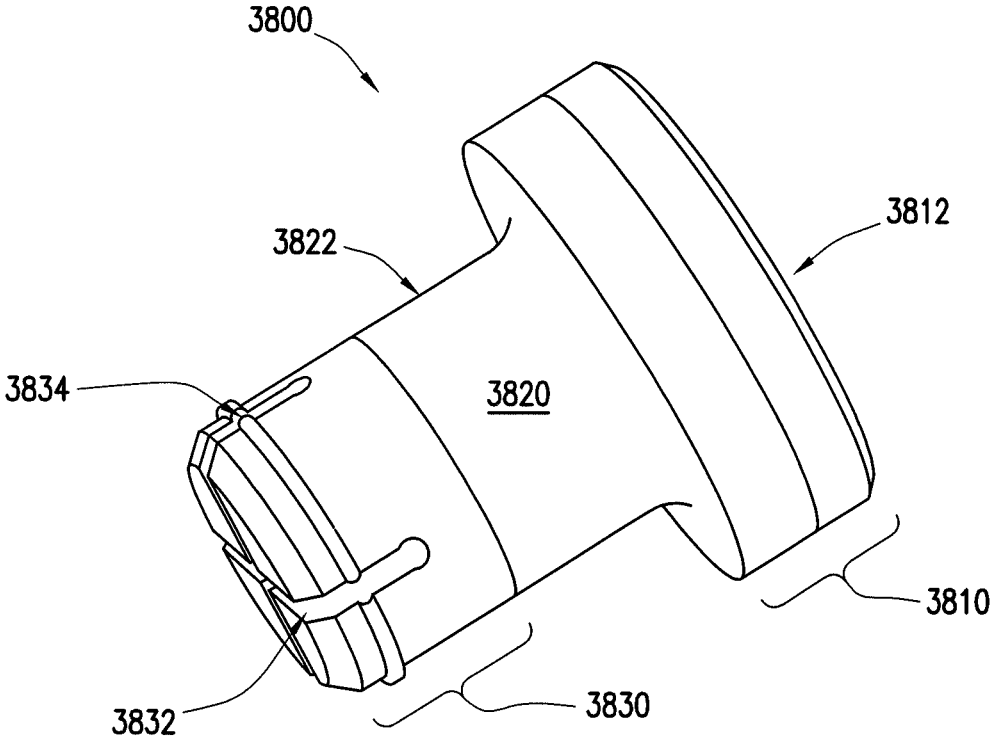
FIG. 38 shows a cutting element according to embodiments of the present disclosure.

FIG. 38 shows a cutting element 3800 according to embodiments of the present disclosure. The cutting element 3800 has a cutting end 3810 having a cutting face 3812, a body 3820, and a retention end 3830 opposite the cutting end 3810. The diameter of the cutting face 3812 is larger than the diameter of a portion of the body 3820 forming a shaft 3822. The retention end 3830 has at least one slit 3832 extending an axial distance along a partial height of the retention end 3830 and extending a transverse distance between the outer circumference of the retention end. As shown, two slits 3832 are formed in the retention end, where each slit extends the diameter of the retention end and intersection at the longitudinal axis of the retention end. However, in some embodiments, one or more slits may be formed in the retention end that do not extend across the diameter of the retention end, but instead extends as a chord from one part of the outer circumference of the retention end to another part of the outer circumference of the retention end. Further, slits may extend planarly or non-planarly the transverse distance. According to embodiments of the present disclosure, a slit may extend an axial distance along the retention end that is less than the total height of the retention end. In some embodiments, the axial distance of at least one slit may range from greater than 50 percent to less than 90 percent of the total height of the retention end.

The retention end 3830 is formed of a different material than the body of the cutting element, where the material of the retention end 3830 is more ductile than the material of the cutting element body. For example, a retention end may be formed of a metallic alloy while the cutting element body may be formed of a carbide material, such as tungsten carbide. Forming the retention end from a more ductile material may allow the retention end to deform in a radial or transverse direction, thereby allowing the retention end to lock into a support.

As shown in FIG. 38, the retention end 3830 also has at least one ridge 3834 formed around its circumference, where the ridge 3834 may contact an inner surface of a support and fit within a recess formed within the support inner surface to axially retain the cutting element within the support. In other embodiments, the retention end may have other surface formations, such as at least one groove formed around the retention end circumference, at least one protrusion, or at least one depression. In embodiments having at least one groove or depression formed around the retention end, a corresponding protrusion may be formed along the inner surface of a support to axially lock the cutting element within the support.

Figure 39:
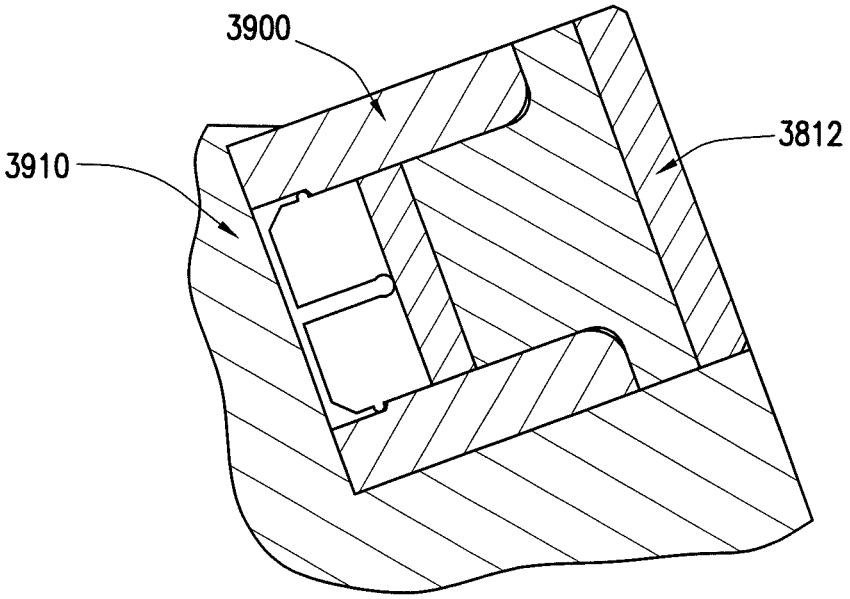
FIG. 39 shows a cross-sectional view of a cutting element assembly according to embodiments of the present disclosure.
Figure 40:
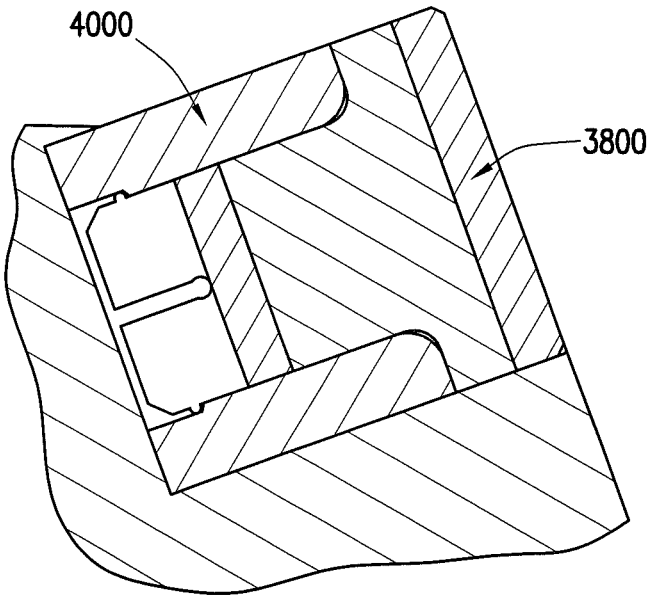
FIG. 40 shows a cross-sectional view of a cutting element assembly according to embodiments of the present disclosure.

As shown in FIG. 39, the cutting element 3800 may be inserted into a support sleeve 3900, which may be attached within a pocket formed in a cutting tool body 3910. In other embodiments, as shown in FIG. 40, the cutting element 3800 may be inserted directly into a pocket formed in a cutting tool body 4000, where the cutting tool body 4000 forms the support.

Cutting element assemblies according to embodiments of the present disclosure may be used on cutting tools for drilling downhole. For example, a cutting tool may include a tool body and a plurality of blades extending from the tool body, where at least one blade has a pocket formed at a cutting edge of the blade. A rotatable cutting element may be retained within the pocket using a retention mechanism according to embodiments of the present disclosure, where the retention mechanism is disposed between the rotatable cutting element and the pocket, and where at least the axial dimension of the retention mechanism is deformable. In some embodiments, a rotatable cutting element may be retained within a support sleeve using a retention mechanism according to embodiments of the present disclosure, where the retention mechanism is disposed between the rotatable cutting element and the sleeve, and where at least the axial dimension of the retention mechanism is deformable. The sleeve may be attached within the pocket of a tool body, such as by brazing.

The cutting elements illustrated in FIGS. 23-42 include a cutting element formed from two materials, an ultrahard layer having a planar cutting face, and a substrate on which the ultrahard material is disposed. The cutting elements illustrated in FIGS. 2-22 generally show a cutting element having a non-planar cutting tip (which may be formed from an ultrahard material) disposed on one or more substrate materials. While particular non-planar cutting surfaces are depicted in FIGS. 2-22, any suitable planar or non-planar cutting surface may be used. Further, while the use of multiple substrate materials may be desirable for some applications involving the use of non-planar cutting tips, it is also within the scope of the present disclosure that the non-planar cutting tip may be directly attached to the substrate material that forms the shank, particularly when used in applications involving downhole cutting tools, such as drill bits. Further, it is specifically within the scope of the present disclosure that such non-planar cutting tipped cutting elements may be used and configured within a support in a manner that allows for rotation of the cutting element within the support.

One or more embodiments described herein may have an ultrahard material disposed on a substrate. Such ultrahard materials may include a conventional polycrystalline diamond table (a table of interconnected diamond particles having interstitial spaces therebetween in which a metal component (such as a metal catalyst) may reside), a thermally stable diamond layer (i.e., having a thermal stability greater than that of conventional polycrystalline diamond, 750° C.) formed, for example, by substantially removing metal from the interstitial spaces between interconnected diamond particles or from a diamond/silicon carbide composite, or other ultrahard material such as a cubic boron nitride. Further, in particular embodiments, the rolling cutter may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are generally found within the interstitial spaces in the diamond lattice structure. Cobalt has a substantially different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Briefly, a strong acid, such as hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material.

In one or more other embodiments, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is optionally disposed may be formed of a variety of hard or ultrahard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt may be for illustrative purposes, and no limitation on the type substrate or binder used is intended. In another embodiment, the substrate may also be formed from a diamond ultrahard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be desirable to have a single diamond composite forming the cutting face and substrate or distinct layers. Specifically, in embodiments where the cutting element is a rotatable cutting element, the entire cutting element may be formed from an ultrahard material, including thermally stable diamond (formed, for example, by removing metal from the interstitial regions or by forming a diamond/silicon carbide composite).

The retention element may be formed from any suitable material, such as tool steel or other alloy steels, nickel-based alloys, and cobalt-based alloys. One of ordinary skill in the art would also recognize one or more components may be coated with a hardfacing material or other wear resistant material for increased erosion protection. Such coatings may be applied by various techniques known in the art such as, for example, detonation gun (d-gun) and spray-and-fuse techniques.

The cutting elements of the present disclosure may be incorporated in various types of cutting tools, including for example, as cutters in fixed cutter bits or hole enlargement tools such as reamers. Bits having the cutting elements of the present disclosure may include a single rolling cutter with the remaining cutting elements being conventional fixed cutting elements, all cutting elements being rotatable, or any combination therebetween of rolling cutters and conventional (brazed), fixed cutters, as well as mechanically retained fixed cutters (including those of the present disclosure). Further, cutting elements of the present disclosure may be disposed on cutting tool blades (such as drag bit blades or reamer blades) having other wear elements incorporated therein. For example, cutting elements of the present disclosure may be disposed on diamond impregnated blades. Additionally, one of ordinary skill in the art would recognize that there exists no limitation on the sizes of the cutting elements of the present disclosure. For example, in various embodiments, the cutting elements may be formed in sizes including, but not limited to, 9 mm, 11 mm, 13 mm, 16 mm, and 19 mm.

Further, one of ordinary skill in the art would also appreciate that any of the design modifications as described above, including, for example, side rake, back rake, variations in geometry, surface alteration/etching, seals, bearings, material compositions, diamond or similar low-friction bearing surfaces, etc., may be included in various combinations not limited to those described above in the cutting elements of the present disclosure. In one embodiment, a cutter may have a side rake ranging from 0 to ±45 degrees. In another embodiment, a cutter may have a back rake ranging from about 5 to 35 degrees.

Figure 43:
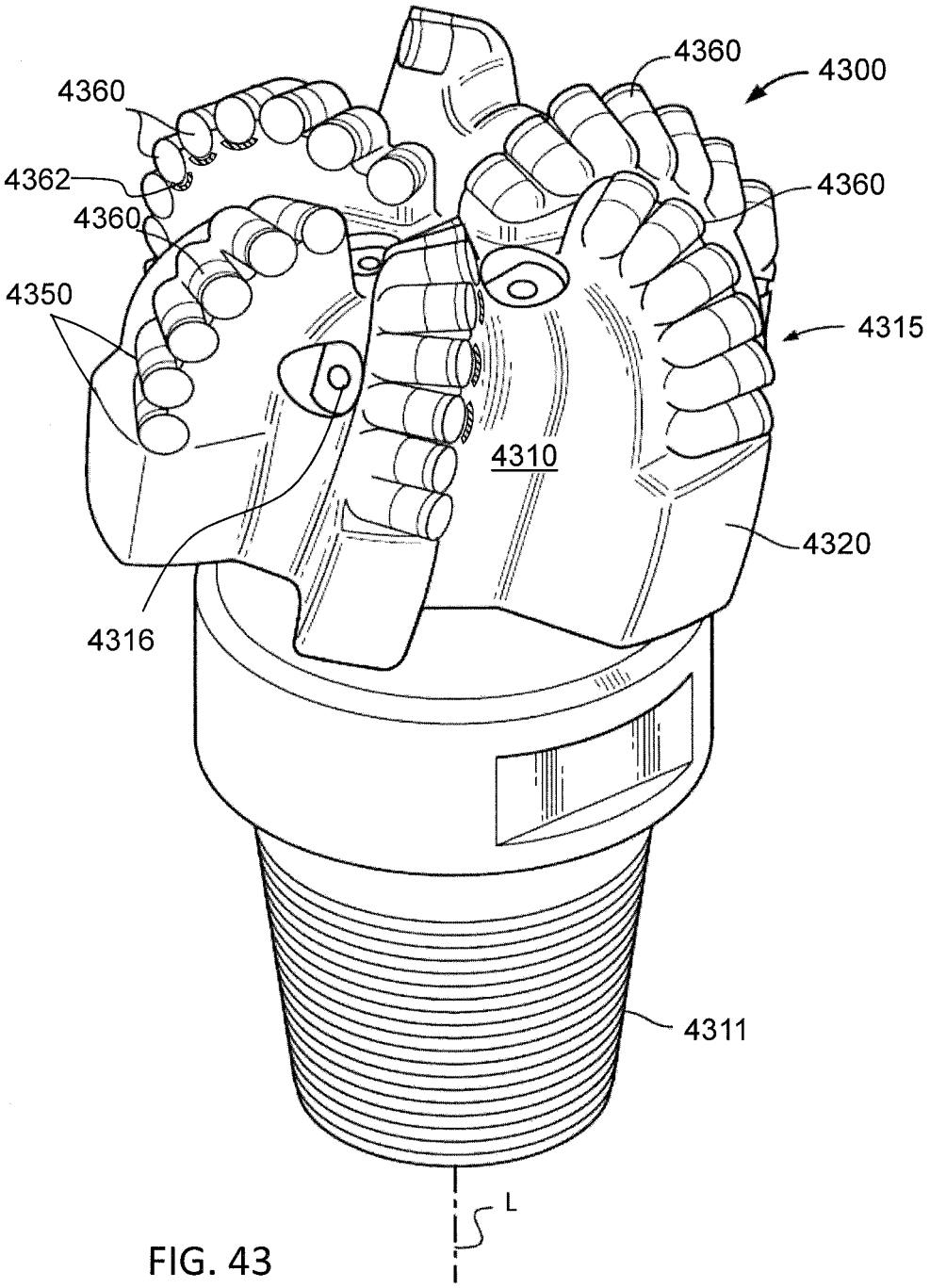
FIG. 43 shows a side view of a drill bit including a plurality of cutting elements of the present disclosure.

An example of PDC bit having a plurality of rolling cutters and fixed cutters is shown in FIG. 43. The drill bit 4300 includes a bit body 4310 having a threaded upper pin end 4311 and a cutting end 4315. The cutting end 4315 includes a plurality of ribs or blades 4320 arranged about the rotational axis L (also referred to as the longitudinal or central axis) of the drill bit and extending radially outward from the bit body 4310. Conventional fixed cutting elements, or cutters, 4350 are embedded in the blades 4320 at predetermined angular orientations and radial locations relative to a working surface and with a desired back rake angle and side rake angle against a formation to be drilled. In addition to fixed cutters 4350, the bit 4300 also includes a plurality of rolling cutters 4360, retained by retaining elements (not shown), as disclosed herein.

A plurality of orifices 4316 are positioned on the bit body 4310 in the areas between the blades 4320, which may be referred to as "gaps" or "fluid courses." The orifices 4316 are commonly adapted to accept nozzles. The orifices 4316 allow drilling fluid to be discharged through the bit in selected directions and at selected rates of flow between the blades 4320 for lubricating and cooling the drill bit 4300, the blades 4320, fixed cutters 4350, and rolling cutters 4360. The drilling fluid also cleans and removes the cuttings as the drill bit 4300 rotates and penetrates the geological formation. The fluid courses are positioned to provide additional flow channels for drilling fluid and to provide a passage for formation cuttings to travel past the drill bit 4300 toward the surface of a wellbore (not shown).

Figure 44:
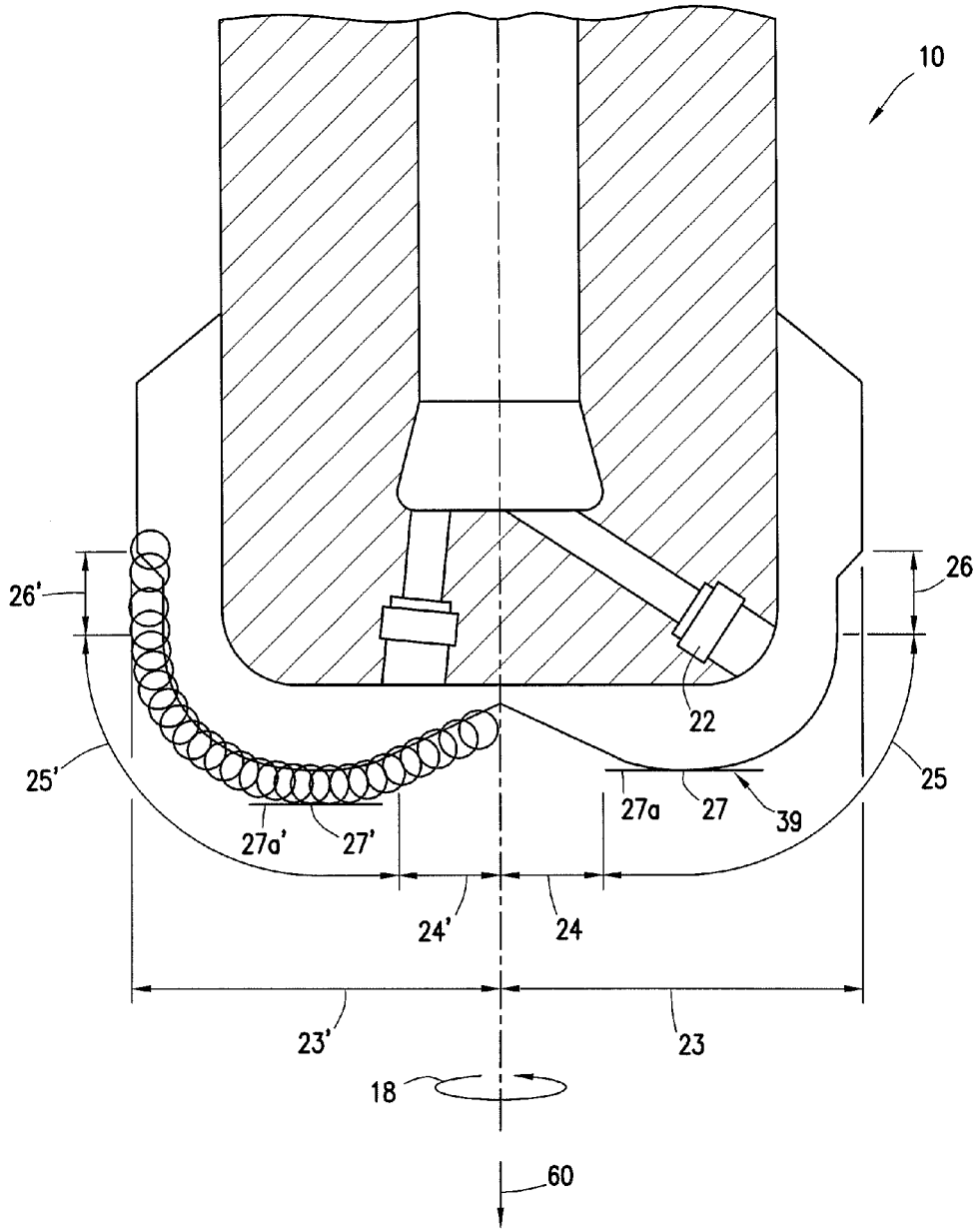
FIG. 44 shows a rotated profile view of a drill bit.

In one or more embodiments, rolling cutters may be disposed in locations of the bit or other tool experiencing the greatest wear, such as the nose or shoulder of the bit. Referring now to FIG. 44, a profile of bit 10 is shown as it would appear with all blades and cutting faces 44 of all cutting elements 40 (including both fixed cutters such as those referenced as 4350 in FIG. 43 and rolling cutters such as those referenced as 4360 in FIG. 43) rotated into a single rotated profile. In rotated profile view, blade tops of all blades of bit form and define a combined or composite blade profile 39 that extends radially from bit axis 60 to outer radius 23 of bit 10. Thus, as used herein, the phrase "composite blade profile" refers to the profile, extending from the bit axis to the outer radius of the bit, formed by the blade tops of all the blades of a bit rotated into a single rotated profile (i.e., in rotated profile view). In one or more embodiments, the cutters referenced as 4360 may be mechanically retained in accordance with the present disclosure, but not able to rotate.

Composite blade profile 39 (most clearly shown in the right half of bit 10 in FIG. 44) may generally be divided into three regions conventionally labeled cone region 24, shoulder region 25, and gage region 26. Cone region 24 comprises the radially innermost region of bit 10 and composite blade profile 39 extending generally from bit axis 60 to shoulder region 25. As shown in FIG. 44, in most conventional fixed cutter bits, cone region 24 is generally concave. Adjacent cone region 24 is shoulder (or the upturned curve) region 25. In most conventional fixed cutter bits, shoulder region 25 is generally convex. Moving radially outward, adjacent shoulder region 25 is the gage region 26 which extends parallel to bit axis 60 at the outer radial periphery of composite blade profile 39. Thus, composite blade profile 39 of bit 10 includes one concave region—cone region 24, and one convex region—shoulder region 25.

The axially lowermost point of convex shoulder region 25 and composite blade profile 39 defines a blade profile nose 27. At blade profile nose 27, the slope of a tangent line 27*a* to convex shoulder region 25 and composite blade profile 39 is zero. Thus, as used herein, the term "blade profile nose" refers to the point along a convex region of a composite blade profile of a bit in rotated profile view at which the slope of a tangent to the composite blade profile is zero. For most conventional fixed cutter bits (e.g., bit 10), the composite blade profile includes only one convex shoulder region (e.g., convex shoulder region 25), and only one blade profile nose (e.g., nose 27). In one or more embodiments, rolling cutters of the present disclosure may be located in the nose and/or shoulder region of the cutting profile, and fixed cutters may be located in the cone and/or gage of the cutting profile. In other embodiments, the rolling cutters may also be disposed in the cone and/or gage of the cutting profile. For example, referring back to FIG. 43, rolling cutters 4360 are located in at least some of the nose and shoulder regions of the blades 4320, while fixed cutters 4350 are located in the cone and gage regions of the blade 4320. It is also within the scope of the present disclosure that the nose and shoulder may also include fixed cutters as either primary or back-up cutting elements.

Figure 45:
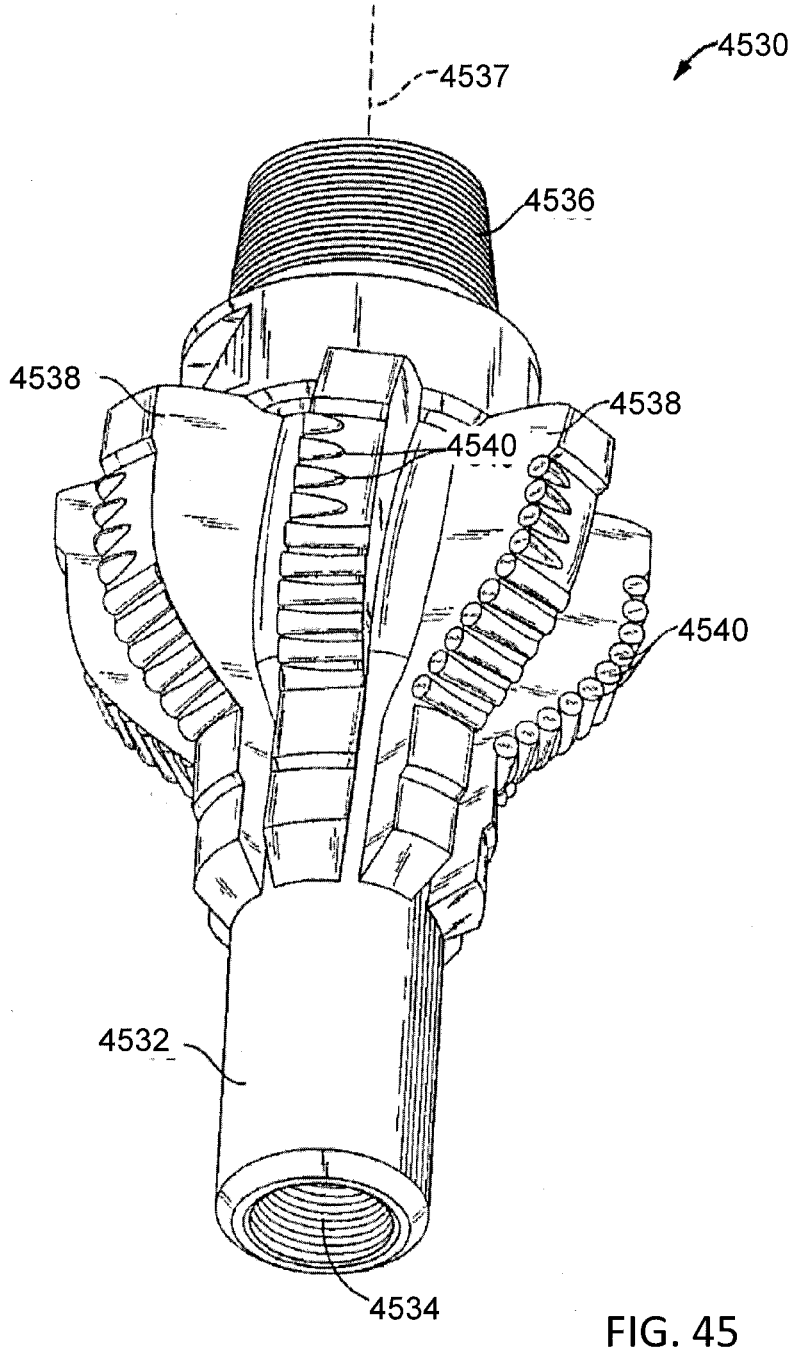
FIG. 45 shows a tool that may use the cutting elements of the present disclosure.

As described throughout the present disclosure, the cutting elements may be used on any downhole cutting tool, including, for example, a fixed cutter drill bit or hole opener. FIG. 45 shows a general configuration of a hole opener 4530 that includes one or more cutting elements of the present disclosure. The hole opener 4530 comprises a tool body 4532 and a plurality of blades 4538 disposed at selected azimuthal locations about a circumference thereof. The hole opener 4530 generally comprises connections 4534, 4536 (e.g., threaded connections) so that the hole opener 4530 may be coupled to adjacent drilling tools that comprise, for example, a drillstring and/or bottom hole assembly (BHA) (not shown). The tool body 4532 generally includes a bore therethrough so that drilling fluid may flow through the hole opener 4530 as it is pumped from the surface (e.g., from surface mud pumps (not shown)) to a bottom of the wellbore (not shown). The tool body 4532 may be formed from steel or from other materials known in the art. For example, the tool body 4532 may also be formed from a matrix material infiltrated with a binder alloy. The blades 4538 shown in FIG. 45 are spiral blades and are generally positioned at substantially equal angular intervals about the perimeter of the tool body. This arrangement is not a limitation on the scope of the disclosure, but rather is used for illustrative purposes. Those having ordinary skill in the art will recognize that any suitable downhole cutting tool may be used. While FIG. 45 does not detail the location of the rolling cutters or mechanically retained cutters, their placement on the tool may be according to any of the variations described above.

Although only a few example embodiments have been described in detail above, those skilled in the art will readily appreciate that many modifications are possible in the example embodiments without materially departing from this disclosure. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A cutting element assembly comprising:

a cutting element partially disposed within a support; and a retention mechanism disposed between the cutting element and the support, wherein an axial dimension of the retention mechanism is compressed, a radial dimension of the retention mechanism is expanded, and the retention mechanism has an arcuate cross-sectional shape along the axial dimension when the cutting element is in an installed position within the support.

2. The cutting element assembly of claim 1, wherein the cutting element is rotatable within the support.

3. The cutting element assembly of claim 1, wherein the cutting element is fixed axially and rotationally within the support.

4. The cutting element assembly of claim 1, further comprising a retention cap attached at a base of the cutting element, wherein an annular recess is formed around a circumference of the cutting element base between a bottom race formed in the retention cap and a top race formed in the cutting element, and wherein the retention mechanism is disposed within the annular recess between the bottom race and the top race.

5. The cutting element assembly of claim 1, further comprising a retention sleeve attached around a base of the cutting element, wherein an annular recess is formed around a circumference of the cutting element base between a bottom race formed by the retention sleeve and a top race formed in the cutting element, and wherein the retention mechanism is disposed within the annular recess between the bottom race and the top race.

6. The cutting element assembly of claim 1, wherein the retention mechanism is cylindrical or a truncated conical shaped ring, and has the arcuate cross-sectional shape when the cutting element is in the installed position.

7. The cutting element assembly of claim 6, wherein an outer surface of the arcuate cross-sectional shape is convex and extends radially inwardly from the support.

8. The cutting element assembly of claim 1, wherein the retention mechanism has a truncated conical shape.

9. The cutting element assembly of claim 1, wherein the retention mechanism is assembled around the cutting element using more than one piece.

10. The cutting element assembly of claim 1, wherein the retention mechanism includes a plurality of surface alterations formed on an outer surface of the retention mechanism, the plurality of surface alterations extending radially outward from the outer surface or extending radially inward from the outer surface a partial thickness of the retention mechanism.

11. The cutting element assembly of claim 1, wherein the retention mechanism includes a plurality of cuts extending through a full thickness of the retention mechanism.

12. The cutting element assembly of claim 11, wherein the retention mechanism includes upper and lower flanges, wherein the plurality of cuts do not extend axially to the upper or lower flanges, and wherein the plurality of cuts are elliptical or are angled along a circumference of the retention mechanism.

13. The cutting element assembly of claim 1, wherein the support is a sleeve disposed around the cutting element and extends axially a partial height along the cutting element.

14. A cutting element assembly comprising:

a cutting element partially disposed within a support, the cutting element having an annular recess, the annular recess having an annular recess height; and a retention mechanism disposed between the cutting element and the support, a radial dimension of the retention mechanism being deformable, wherein the annular recess height is less than a relaxed height of the retention mechanism, and the retention mechanism has an arcuate cross-sectional shape along its axial dimension when installed in the annular recess.

15. The cutting element assembly of claim 14, wherein the cutting element is rotatable within the support.

16. The cutting element assembly of claim 14, wherein the cutting element is fixed axially and rotationally within the support.

17. The cutting element assembly of claim 14, wherein the support comprises a cutting tool body.

18. The cutting element assembly of claim 14, wherein the support is a sleeve disposed around the cutting element and extending axially a partial height along the cutting element.

19. The cutting element assembly of claim 14, the retention mechanism having an upper end and a lower end, the upper end engaging a top race in the support and the lower end engaging a bottom race in the support.

20. A cutting element assembly comprising:

a cutting element partially disposed within a support; and a retention mechanism between the cutting element and the support, the retention mechanism having an arcuate cross-sectional shape, a radial dimension of the retention mechanism being deformable, and an outer surface of the retention mechanism having a concave profile extending an entire height of the retention mechanism.

21. The cutting element assembly of claim 20, the support including an annular recess, the retention mechanism being in the annular recess, and a height of the annular recess being less than a relaxed height of the retention mechanism.

* * * * *